US010947973B2

(12) United States Patent
Naganuma et al.

(10) Patent No.: US 10,947,973 B2
(45) Date of Patent: Mar. 16, 2021

(54) VARIABLE CAPACITY OIL PUMP

(71) Applicant: HITACHI AUTOMOTIVE SYSTEMS, LTD., Hitachinaka (JP)

(72) Inventors: Atsushi Naganuma, Atsugi (JP); Hideaki Ohnishi, Atsugi (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 306 days.

(21) Appl. No.: 15/749,893

(22) PCT Filed: Jul. 14, 2016

(86) PCT No.: PCT/JP2016/070775
§ 371 (c)(1),
(2) Date: Feb. 2, 2018

(87) PCT Pub. No.: WO2017/026224
PCT Pub. Date: Feb. 16, 2017

(65) Prior Publication Data

US 2018/0223840 A1 Aug. 9, 2018

(30) Foreign Application Priority Data

Aug. 10, 2015 (JP) ..... 2015-157856

(51) Int. Cl.
*F03C 2/00* (2006.01)
*F03C 4/00* (2006.01)
(Continued)

(52) U.S. Cl.
CPC ..... *F04C 14/226* (2013.01); *F01M 1/02* (2013.01); *F04C 2/344* (2013.01); *F04C 2/3442* (2013.01);
(Continued)

(58) Field of Classification Search
CPC ..... F04C 2/344; F04C 2/3442; F04C 14/22; F04C 14/226; F04C 14/24; F04C 14/28;
(Continued)

(56) References Cited

U.S. PATENT DOCUMENTS 4,342,545 A * 8/1982 Schuster ..... F04C 14/226 418/26
4,538,966 A * 9/1985 Nikaido ..... F04C 14/24 417/288
(Continued)

FOREIGN PATENT DOCUMENTS

JP 2014-051924 A 3/2014
JP 2014-105623 A 6/2014
(Continued)

*Primary Examiner* — Theresa Trieu
(74) *Attorney, Agent, or Firm* — Foley & Lardner LLP

(57) ABSTRACT

A variable displacement oil pump includes: a pump constituting section; a movable member; an urging mechanism; a control hydraulic chamber group; a drain mechanism arranged to discharge the oil from a specific one control hydraulic chamber of the control hydraulic chamber group; and a control valve which into which the oil of an upstream side that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber.

16 Claims, 19 Drawing Sheets

(51) Int. Cl.

| | |
|---|---|
| ***F04C 2/00*** | (2006.01) |
| ***F04C 14/22*** | (2006.01) |
| ***F04C 2/344*** | (2006.01) |
| ***F04C 14/28*** | (2006.01) |
| ***F01M 1/02*** | (2006.01) |
| ***F04C 14/24*** | (2006.01) |
| ***F04C 15/00*** | (2006.01) |

(52) U.S. Cl.
CPC ..... *F04C 14/22* (2013.01); *F04C 14/24* (2013.01); *F04C 14/28* (2013.01); *F04C 15/008* (2013.01); *F04C 15/0065* (2013.01); *F01M 2001/0238* (2013.01); *F01M 2001/0246* (2013.01); *F04C 2210/14* (2013.01); *F04C 2240/811* (2013.01)

(58) Field of Classification Search
CPC ..... F04C 15/0065; F04C 15/008; F04C 2210/14; F04C 2240/811; F01M 1/02; F01M 2001/0238; F01M 2001/0246
USPC ..... 418/26–27, 30, 259, 260, 266–268; 417/218, 220
See application file for complete search history.

(56) References Cited

U.S. PATENT DOCUMENTS

| | | | | |
|---|---|---|---|---|
| 4,737,078 | A * | 4/1988 | Dantlgraber | F04C 14/226 418/26 |
| 2010/0028171 | A1* | 2/2010 | Shulver | F04B 46/06 417/216 |
| 2010/0221126 | A1* | 9/2010 | Tanasuca | F04C 14/226 417/220 |
| 2013/0164163 | A1* | 6/2013 | Ohnishi | F04C 14/226 418/26 |
| 2014/0072456 | A1 | 3/2014 | Watanabe et al. | |
| 2014/0219847 | A1 | 8/2014 | Watanabe et al. | |
| 2015/0020759 | A1 | 1/2015 | Watanabe et al. | |
| 2015/0030485 | A1* | 1/2015 | Cadeddu | F04C 14/223 418/29 |
| 2015/0218983 | A1 | 8/2015 | Watanabe et al. | |

FOREIGN PATENT DOCUMENTS

| | | | | |
|---|---|---|---|---|
| JP | 2015-021400 | A | 2/2015 | |
| JP | 2015161249 | A * | 9/2015 | F04C 14/26 |
| WO | WO-2007/128106 | A1 | 11/2007 | |
| WO | WO-2014/038302 | A1 | 3/2014 | |

* cited by examiner

VARIABLE CAPACITY OIL PUMP

TECHNICAL FIELD

This invention relates to a variable displacement oil pump arranged to supply an oil for lubrication of sliding portions of an internal combustion engine, an oil serving as a driving source of accessories and so on of the internal combustion engine.

BACKGROUND ART

There is known a conventional variable displacement oil pump described in a patent document 1 described below. This variable displacement oil pump is arranged to vary a discharge pressure in accordance with a variation of an eccentric amount of a cam ring with respect to a rotor (hereinafter, referred merely as to "eccentric amount"). This variable displacement oil pump includes a first control hydraulic chamber which is formed on an outer circumference side of the cam ring, and which urges the cam ring in a direction where the eccentric amount is decreased by introduction of the oil; a second control hydraulic chamber which is formed on the outer circumference side, and which constantly urges the cam ring in a direction where the eccentric amount is increased by the introduction of the oil; a coil spring arranged to constantly urge the cam ring in the direction where the eccentric amount is increased; and a third control hydraulic chamber to which the oil is constantly introduced.

Moreover, the variable displacement oil pump includes an electrically controlled mechanism arranged to perform a supply and discharge control of the oil to the first and second control hydraulic chambers, based on an electric signal. By controlling the electrically controlled mechanism, the discharge pressure is continuously controlled.

However, in the conventional variable displacement oil pump, in a case where the malfunction is generated in the pressure adjusting (regulating) control of the control hydraulic chamber, for example, in a case where the electrically controlled mechanism is failed due to the breaking and so on, or in a case where there is the influence of the high viscosity of the oil at the start of the engine, it may become difficult to perform the eccentric amount control of the cam ring, so that it is not possible to control the discharge pressure, when the hydraulic pressure control of the first and second control hydraulic chambers cannot be sufficiently performed.

PRIOR ART DOCUMENT

Patent Document

Patent Document 1: WO2007/128106A1

SUMMARY OF THE INVENTION

Problems which the Invention is Intended to Solve

It is, therefore, an object of the present invention to provide a variable displacement oil pump devised to solve the above-described problems, and to attain a required hydraulic pressure and to suppress an excessive hydraulic pressure increase even when a malfunction is generated in a pressure regulating control of a control hydraulic chamber.

A variable displacement oil pump according to the present invention includes: a pump constituting section arranged to be rotationally driven by an engine, to vary volumes of a plurality of pump chambers, and to discharge an oil sucked from a suction portion; a movable member arranged to be moved to vary variation amounts of the volumes of the plurality of the pump chambers; an urging mechanism provided to have a set load, and arranged to urge the movable member in a direction in which the variation amounts of the volumes of the plurality of the pump chambers are increased; a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the movable member in a direction in which the variation amounts of the volumes of the plurality of the pump chambers are decreased; a drain mechanism arranged to discharge the oil from a specific one control hydraulic chamber of the control hydraulic chamber group; and a control valve which into which the oil of an upstream side that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber.

By the present invention, it is possible to suppress the excessive increase of the hydraulic pressure while attaining the required hydraulic pressure, even when the pressure regulation control of the control hydraulic chamber is failed.

DESCRIPTION OF EMBODIMENTS

Hereinafter, embodiments of variable displacement oil pump (variable capacity oil pump) according to the present invention are explained with reference to the drawings. Besides, in below-described embodiments, the present invention is applied, for example, to a variable displacement oil pump which is an actuation source of a variable valve timing actuation mechanism arranged to vary a valve timing of an engine valve of an internal combustion engine for a vehicle, and which is arranged to supply a lubricant to sliding portions of the engine, in particular, to sliding portions between a piston and a cylinder bore by an oil jet, and to supply the lubricant to bearings of a crank shaft.

First Embodiment

Figure 1:
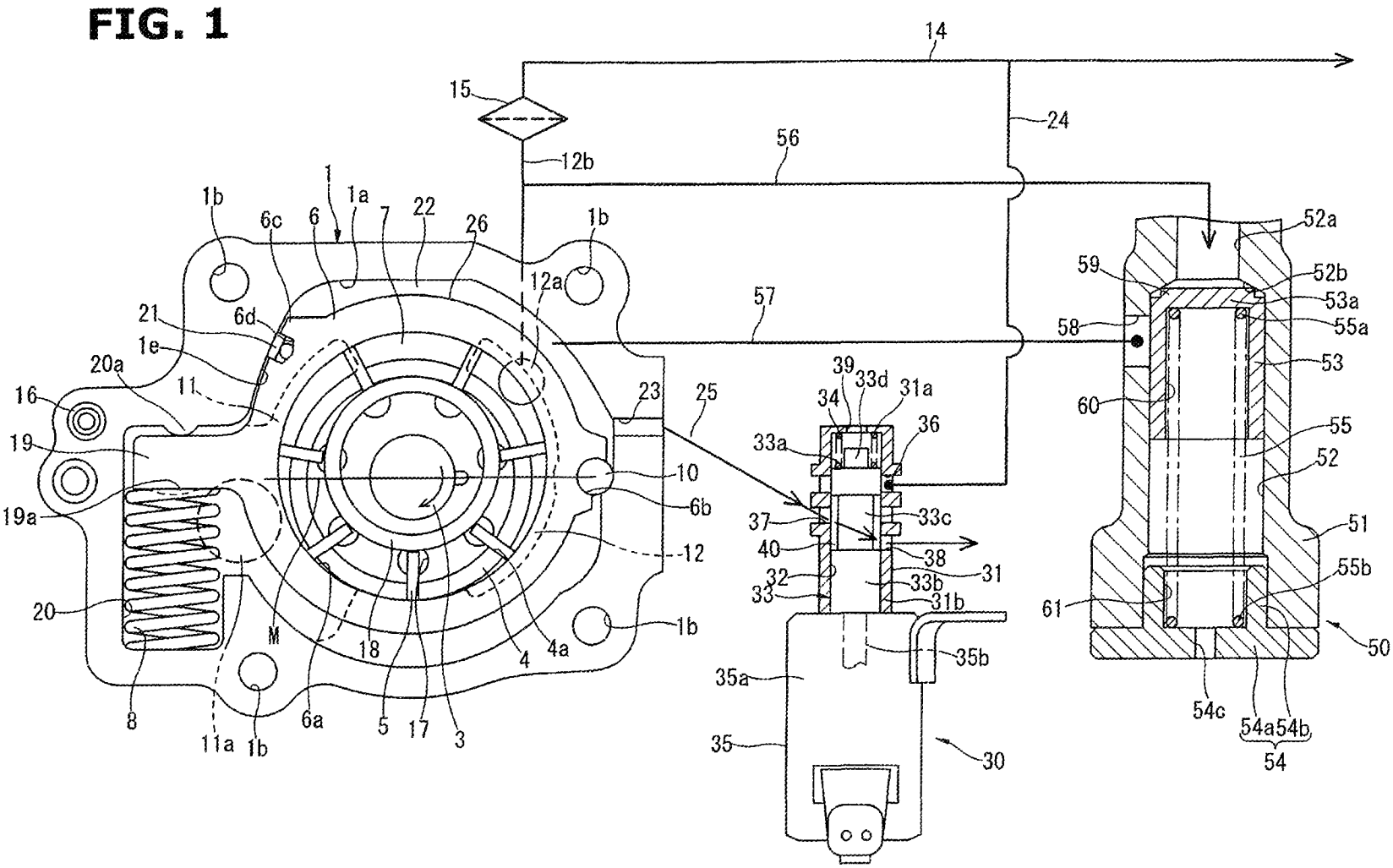
FIG. 1 is a schematic view showing a variable displacement oil pump according to a first embodiment.
Figure 2:
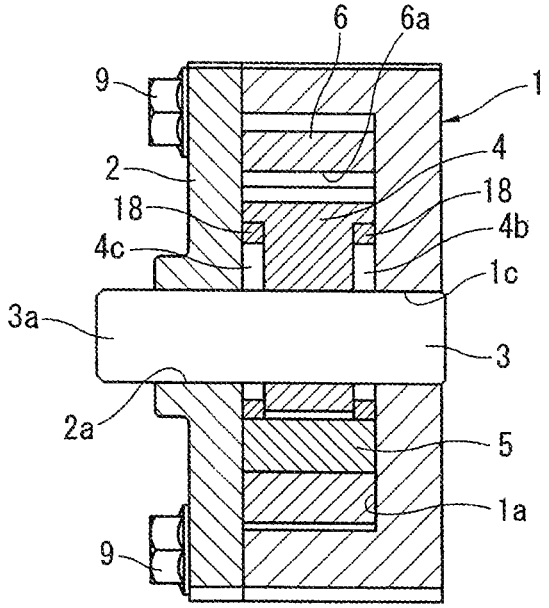
FIG. 2 is a longitudinal sectional view of the variable displacement oil pump.
Figure 3:
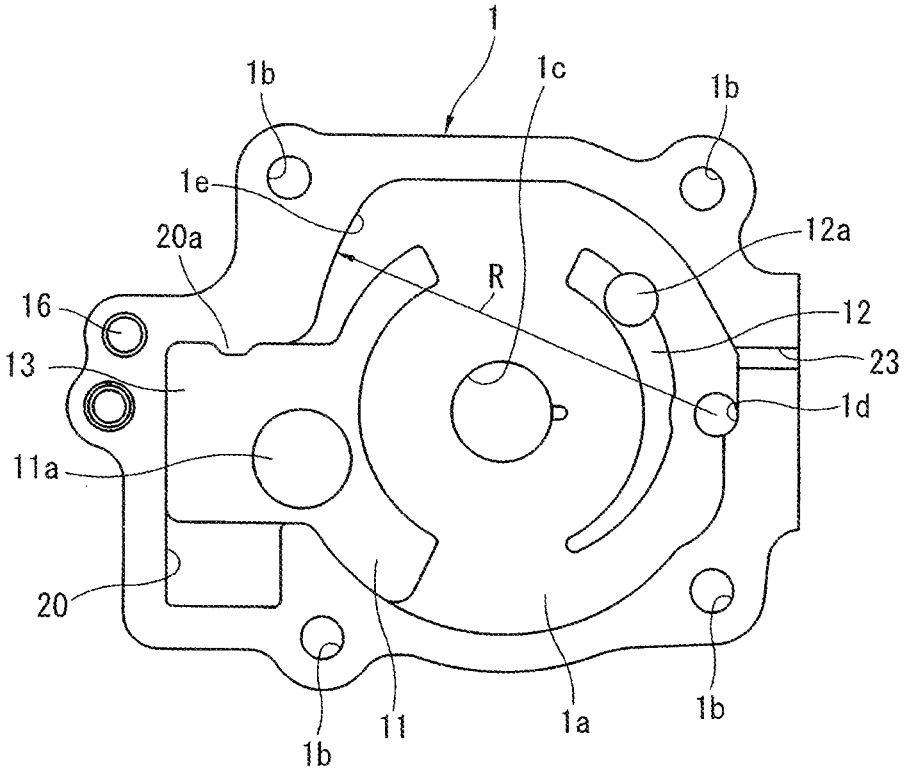
FIG. 3 is a front view showing a pump housing of the variable displacement oil pump.

A variable displacement oil pump according to this embodiment is applied to a vane type. The variable displacement oil pump is provided to a front end portion of a cylinder block (not shown) of an internal combustion engine. As shown in FIG. 1 to FIG. 3, the variable displacement oil pump includes a pump housing 1 which has a bottomed cylindrical shape, and which includes one end side opening, and a pump receiving chamber 1*a* formed inside the pump housing 1; a pump cover 2 closing the one end side opening of the pump housing 1; a drive shaft 3 disposed and inserted to a substantially central portion of the pump housing 1, and rotationally driven by a crank shaft (not shown) of the engine; a rotor 4 which is rotationally received within the pump receiving chamber 1*a*, and which has a central portion connected to the drive shaft 3; a plurality of vanes 5 each of which is received in one of a plurality of slits 4*a* that are radially formed in the outer circumference portion of the rotor 4 by cutting, and each of which is arranged to be projectable from and retractable into the one of the slits 4*a*; a cam ring 6 which is a movable member, which is disposed on an outer circumference side of the vanes 5, which is arranged to be swung (moved) to be eccentric with respect to a center of the rotation of the rotor 4, and which defines a plurality of pump chambers 7 with the rotor 4 and adjacent vanes 5 and 5; and a coil spring 8 which is an urging mechanism, which is received within the pump housing 1, and which is arranged to constantly urge the cam ring 6 in a direction in which an eccentric amount is increased. Besides, the driving shaft 3, the rotor 4, and the vanes 5 constitute a pump constituting section.

As shown in FIG. 2, the pump housing 1 and the pump cover 2 are integrally connected by four bolts 9 when the pump housing 1 and the pump cover 2 are mounted to a cylinder block (not shown). These bolts 9 are inserted, respectively, through bolt insertion holes 1*b* (cf. FIG. 1 and FIG. 3) and so on which are formed, respectively, in the pump housing 1 and the pump cover 2. Tip end portions of the bolts 9 are tightened and screwed, respectively, in internal screw holes (not shown) formed in the cylinder block.

The pump housing 1 is integrally formed from aluminum alloy material. In the pump housing 1, a bottom surface of the pump receiving chamber 1*a* is slide on one axial side surface of the cam ring 6. Accordingly, the bottom surface of the pump receiving chamber 1*a* is formed by mechanical working and so on to have a high accuracy flatness and a high accuracy surface roughness in a sliding abutment range.

Moreover, as shown in FIG. 3, the pump housing 1 includes a bearing hole 1*c* which penetrate through the bottom surface of the pump receiving chamber 1*a*, which is formed at a substantially central position of the bottom surface of the pump receiving chamber 1*a*, and which rotationally supports one end portion of the drive shaft 3; and a pin hole 1*d* which is formed at a predetermined position of the inner circumference surface of the pump housing 1, which has a bottomed shape, and in which a pivot pin 10 that is a swinging point of the cam ring 6 is inserted.

Furthermore, the pump housing 1 includes a seal sliding abutment surface 1*e* which is formed on the inner circumference surface that is positioned on a vertically upper side of a line M (hereinafter, referred to as "cam ring reference line") connecting an axis of the pivot pin 10 and a center of the pump housing 1 (axis of the drive shaft 3), as shown in FIG. 1, and on which a seal member 21 mounted in a seal groove 6*d* (described later) of the cam ring 6 is constantly slidingly abutted. As shown in FIG. 3, this seal sliding abutment surface 1*e* has an arc surface shape having a radius R which is a predetermined length from a center of the pin hole 1*d*. The seal member 21 is arranged to be constantly slidingly abutted on the seal sliding abutment surface 1*e* in a range in which the cam ring 6 is eccentrically swung.

Moreover, as shown in FIG. 1 and FIG. 3, the bottom surface of the pump receiving chamber 1*a* includes a suction port 11 which is formed in an outer circumference region of the bearing hole 1*c*, and which has a substantially arc recessed shape opened in a region (suction region) in which an internal volume of the pump chamber 7 is increased in accordance with a pump operation of the pump constituting section; and a discharge port 12 which is formed in the outer circumference region of the bearing hole 1*c*, and which has a substantially arc recessed shape opened in a region (discharge region) in which the internal volume of the pump chamber 7 is decreased in accordance with the pump operation of the pump constituting section. The suction port 11 and the discharge port 12 are formed by cutting to confront each other to sandwich the bearing hole 1*c*.

As shown in FIG. 3, the suction port 11 is integrally provided with an introduction portion 13. The introduction portion 13 is formed at a substantially central portion of the suction port 11 to protrude on a side of a coil spring receiving chamber 20. Furthermore, the suction port 11 is provided with a suction hole 11*a* which has a substantially circular cross section, which is formed at a connection portion between the suction port 11 and the introduction portion 13, and which penetrates through the bottom wall of the pump housing 1 to be opened to an outside. The suction port 11 is connected through the suction hole 11*a* to an oil pan (not shown). With this, the oil stored in the oil pan is sucked through the suction hole 11*a* and the suction port 11 to the pump chambers 7 in the suction region based on a negative pressure generated in accordance with the pump operation by the pump constituting section. Besides, the suction port 11 and the suction hole 11*a* constitute a suction portion.

On the other hand, the discharge port 12 is provided with a discharge hole 12*a* which has a substantially circular cross section, which is formed at an upper position in FIG. 3, and which penetrates through the bottom wall of the pump housing 1 to be opened to the outside. The discharge port 12 is connected through the discharge hole 12*a* to a discharge passage 12*b*. As shown in FIG. 1, this discharge passage 12*b* includes a downstream end connected to a main oil gallery 14 of the engine. Besides, the discharge port and the discharge hole 12*a* constitute a discharge portion.

Hereinafter, meanings of the oil of the upstream side and the oil of the downstream side which are discharged from the discharge portion, and which relate to the claims are explained. The oil of the upstream side which is discharged from the discharge portion is an oil which is discharged from the discharge hole 12*a*, and which is in the discharge passage 12*b* before an oil filter 15 (described later), and in a discharge pressure introduction passage 56 (described later). That is, the oil of the upstream side which is discharged from the discharge portion is an oil which does not pass through the oil filter 15, and which is newly discharged from the discharge hole 12*a*. On the other hand, the oil of the downstream side which is discharged from the discharge portion is an oil which is discharged from the discharge hole 12*a*, and which passed through the oil filter 15 (described later). The oil of the downstream side which is discharged from the discharge portion is represented by a main oil gallery 14 in FIG. 1.

By the above-described structure, the oil which is within the pump chambers 7 in the discharge region, and which is pressurized by the pump operation of the pump constituting section is discharged through the discharge port 12, the discharge hole 12*a*, and the discharge passage 12*b* to the main oil gallery 14. The oil is supplied through the main oil gallery 14 to sliding portions within the engine, for example, a valve timing control device which is a variable valve actuating device, bearings of the crank shaft, and so on.

Moreover, an oil cooler (not shown) and the oil filter 15 are provided at a connection portion between the discharge passage 12*b* and the main oil gallery 14. The oil cooler is arranged to cool the oil flowing in the inside. The oil filter 15 is arranged to catch foreign objects in the oil, and to dampen the pulsation of the oil discharged from the discharge port 12.

The oil passes through the oil filter 15. With this, a hydraulic pressure (hereinafter, referred to as "main gallery pressure") of the oil flowing within the main oil gallery 14 is slightly depressurized relative to the hydraulic pressure of the oil (hereinafter, referred to as "discharge pressure") which is newly (recently) discharged from the discharge port 12.

As shown in FIG. 2, the pump cover 2 is formed from the aluminum alloy material into a substantially plate shape. The pump cover 2 includes a bearing hole 2*a* which is formed at a substantially central position, and which rotatably supports the other end portion of the drive shaft 3. This pump cover 2 is positioned through a positioning pin 16 (cf. FIG. 1) fixed to the pump housing 1, in a circumferential direction with respect to the pump housing 1.

Besides, in this embodiment, an inner side surface of the pump cover 2 is formed into a substantially flat shape. The suction port, the discharge port, a lubricant groove may be formed in the inner side surface of the pump cover 2, similarly to the bottom surface of the pump receiving chamber 1*a*.

A rotational force is transmitted from the crank shaft through gears and so on to a tip end portion of the drive shaft 3 which protrudes from the pump cover 2. The drive shaft 3 is arranged to rotate the rotor 4 in an arrow direction (clockwise direction) of FIG. 1 by this rotational force.

As shown in FIG. 1, the rotor 4 includes seven slits 4*a* which are formed by cutting from an inside central side to a radially outward side in radial directions; and back pressure chambers 17 each of which has a substantially circular section, and into which the discharge pressure is introduced from the discharge port 12.

The vanes 5 are arranged to be pushed in the outside directions by the centrifugal force according to the rotation of the rotor 4, and the back pressures of the back pressure chambers 17, and thereby to be slidingly abutted on the inner circumference surface of the cam ring 6. The pump chambers 7 are liquid-tightly defined by the confronting inner side surfaces of adjacent vanes 5 and 5, the inner circumference surface 6*a* of the cam ring 6, the outer circumference surface of the rotor 4, the bottom surface of the pump receiving chamber 1*a*, and the inner side surface of the pump cover 2.

The rotor 4 includes a pair of front and rear ring grooves 4*b* and 4*c* which are formed on both axial side surfaces of the rotor 4. A pair of annular vane rings 18 and 18 are received, respectively, within the ring grooves 4*b* and 4*c*. These vane rings 18 include outer circumference surfaces slidingly abutted on base end edges of the vanes 5. These vane rings 18 are arranged to push the vanes 5 in the radially outward direction in accordance with the rotation. With this, the tip end portions of the vanes 5 are slidingly abutted on the inner circumference surface 6*a* of the cam ring 6 to liquid-tightly separate the pump chambers even when the engine speed is low, and the centrifugal force and the pressures of the back pressure chambers 17 are small.

The cam ring 6 is integrally formed from easily machined sintered metal into a substantially cylindrical shape. The cam ring 6 includes the pivot recessed portion 6*b* which is formed on the outer circumference surface of the cam ring 6 on the cam ring reference line M at a right outside position. This pivot recessed portion 6*b* is mounted on the pivot pin 10 to serve as an eccentric swing fulcrum of the cam ring 6.

Moreover, an arm 19 is integrally provided with the cam ring 6. The arm 19 is provided on the outer circumference surface of the cam ring 6 at a position opposite to the pivot recessed portion 6*b*. The arm 19 is linked with the coil spring 8. As shown in FIG. 1, this arm 19 extends in the radially outward direction of the cam ring 6. The arm 19 includes a raised portion 19*a* which has a substantially arc raised shape, and which is formed on a lower surface of a tip end portion.

A coil spring receiving chamber 20 is provided at a position opposite to the pin hole 1*d* of the pump housing 1. The coil spring receiving chamber 20 is connected through the introduction portion 13 to the pump receiving chamber 1*a*. The tip end portion of the arm 19 extends within the coil spring receiving chamber 20. The coil spring 8 is received within the coil spring receiving chamber 20.

The coil spring 8 includes one end portion elastically abutted on the raised portion 19*a* of the arm 19; and the other end portion elastically abutted on a bottom surface of the coil spring receiving chamber 20. The coil spring 18 constantly urges the cam ring 6 through the arm 19 in a direction in which the eccentric amount is increased (hereinafter, referred to as "eccentric direction"), that is, in a direction where volume variation amounts of the plurality of the pump chambers 7 are increased. With this, in an actuation state shown in FIG. 1, the upper surface of the arm 19 is pressed to a restriction protruding portion 20*a* formed on a lower surface of an upper wall of the coil spring receiving chamber 20 by the spring force of the coil spring 8, so that the cam ring 6 is held at a position at which the eccentric amount becomes maximum.

A protruding portion 6*c* is formed at an upper position of the cam ring 6 relative to the cam ring reference line M. The protruding portion 6*c* includes a seal surface formed to confront the seal sliding abutment surface 1*e* of the pump housing 1. The protruding portion 6*c* has a substantially triangular shape. The protruding portion 6*c* includes a seal groove 6*d* which has a substantially arc cross section, which is formed by cutting on the seal surface along the axial direction of the cam ring 6. A seal member 21 is received within the seal groove 6*d*. The seal member 21 is arranged to be slidingly abutted on the seal sliding abutment surface 1*e* at the eccentric swing movement of the cam ring 6.

In this case, the seal surface is formed into an arc surface shape with a predetermined radius slightly smaller than the radius R from the center of the pin hole 1*d* to the seal sliding abutment surface 1*e*. The seal surface is slidingly abutted on the seal slidingly abutting surface 1*e* with a minute clearance.

The seal member 21 is formed, for example, from synthetic resin of low abrasion property into a linear elongated shape. The seal member 21 is received within the seal groove 6*d* along the axial direction of the cam ring 6. The seal member 21 is pressed to the seal sliding abutment surface 1*e* by an elastic force of an elastic member which is made from a rubber, and which is disposed on a bottom portion of the seal groove 6*d*. With this, the good sealing characteristic with the seal sliding abutment surface 1*e* is constantly ensured.

Moreover, a control hydraulic chamber group serving for the eccentric amount control of the cam ring 6 is provided in an outer circumference region of the cam ring 6 on a side of the protruding portion 6*c*. In this embodiment, a control hydraulic chamber 22 which is a decrease side control hydraulic chamber is formed on an upper side of the cam ring reference line M in FIG. 1.

This control hydraulic chamber 22 is defined by the inner circumference surface of the pump housing 1, the outer circumference surface of the cam ring 6, the pivot pin 10, the seal member 21, the bottom surface of the pump receiving chamber 1*a*, and the inner side surface of the pump cover 2. A connection hole 23 is formed in a side portion of the pump housing 1 constituting the control hydraulic chamber 22 to penetrate through the side portion of the pump housing 1. The connection hole 33 connects an inside and an outside of the control hydraulic chamber 22.

Furthermore, as shown in FIG. 1, the oil within the main oil gallery 14 is basically introduced into the control hydraulic chamber 22 through a control pressure introduction passage 24 bifurcated from the main oil gallery 14, an electromagnetic switching valve 30 which is an electrically controlled mechanism, the connection passage 25, and the connection hole 23.

Moreover, in the control hydraulic chamber 22, the outer circumference surface of the cam ring 6 constituting the control hydraulic chamber 22 serves as a pressure receiving surface 26. When the oil is supplied to the control hydraulic chamber 22, the control hydraulic chamber 22 acts the hydraulic pressure of the oil to the pressure receiving surface 26 to press the cam ring 6 against the spring force of the coil spring 8 in a direction in which the eccentric amount is decreased (hereinafter, referred to as "concentric direction"), that is, in a direction in which the volume variation amounts of the plurality of the pump chambers 7 are decreased.

A force balance relationship between the spring force of the coil spring 8 and the internal pressure of the control hydraulic chamber 22 can be freely varied by varying a set load of the coil spring 8. In this embodiment, the set load of the coil spring 8 is set so that the cam ring 6 is actuated when the internal pressure of the control hydraulic chamber 22 becomes equal to or greater than a predetermined set pressure smaller than a low pressure P1 which is a required pressure of the engine (described later).

The electromagnetic switching valve 30 is arranged to electrically control the supply to the control hydraulic chamber 22, and the discharge from the control hydraulic chamber 22, and thereby to control the eccentric amount of the cam ring 6. As shown in FIG. 1, the electromagnetic switching valve 30 includes a valve body 31 which has a cylindrical shape with a lid, and which is fixed in the valve receiving hole formed in the cylinder block (not shown) by the press fit; a spool valve member 33 which is slidably received within a sliding hole 32 formed within the valve body 31; a valve spring 34 which is arranged to constantly urge the spool valve member 33 in a downward direction of the drawing; and a solenoid section 35 which is provided at an opening end portion of the valve body 31, and which is arranged to urge the spool valve member 33 in the upward direction of the drawing in accordance with a driving state and so on.

The valve body 31 includes an introduction port 36 connected to the control pressure introduction passage 24; a connection port 37 connected through the connection passage 25 and the connection hole 23 to the control hydraulic chamber 22; and a drain port 38 which is a drain mechanism connected to atmospheric pressure outside the pump. Each of the introduction port 36, the connection port 37, and the drain port 38 is formed to penetrate in the radial direction. The introduction port 36, the connection port 37, and the drain port 38 are formed in this order in the circumferential wall of the valve body 31 from the upper end wall 31*a*'s side to the lower end portion 31*b*'s side. The drain port 38 may be formed to be connected to the suction port 11, in place of the atmospheric pressure.

An air vent hole 39 is formed in the upper end wall 31*a* of the valve body 31 to penetrate through the upper end wall 31*a*. The air vent hole 39 is arranged to be connected to the atmospheric pressure to ensure the good slidability of the spool valve member 33. The air vent hole 39 is for releasing a back pressure.

The spool valve member 33 has an integral solid shape. The spool valve member 33 includes a first land portion 33*a* which has a large diameter cylindrical shape, and which is provided on a side of the upper end wall 31*a* of the valve body 31; a second land portion 33*b* which has a large diameter cylindrical shape, and which is provided on a side of a lower end portion 31*b* of the valve body 31; and a small diameter shaft portion 33*c* which has a relatively small diameter cylindrical shape, and which connects the both land portions 33*a* and 33*b*.

The first and second land portions 33*a* and 33*b* have the same outside diameter. The first and second land portions 33*a* and 33*b* are slid with minute clearances on an inner circumference surface of the sliding hole 32.

An annular passage 40 is formed on the outer circumference side of the small shaft portions 33*c*. The annular passage 40 is formed by the outer circumference surface of the small shaft portion 33*c*, inner side surfaces of the first and second land portions 33*a* and 33*b* which confront each other, and the inner circumference surface of the sliding hole 32. The annular passage 40 is constantly connected to the connection port 37 in a maximally opened state, irrespective of the movement position of the spool valve member 33. On the other hand, the annular passage 40 is arranged to be connected to the introduction port 36 and the drain port 38 in accordance with the sliding position of the spool valve member 33.

Furthermore, a holding protrusion 33*d* is provided on an upper end surface of the first land portion 33*a* which confronts the upper end wall 31*a* of the valve body 31 to protrude. The holding protrusion 33*d* has a relatively small diameter cylindrical shape.

The valve spring 34 is elastically mounted between a lower surface of the upper end wall 31*a* of the valve body 31 and an outer end surface of the first land portion 33*a*. The valve spring 34 constantly urges the spool valve member 33 toward the solenoid section 35. Moreover, the valve spring 34 includes one end portion held by an outer circumference surface of the holding protrusion 33*d* of the spool valve member 33. Accordingly, the valve spring 34 can stably urge the spool valve member 33.

In the solenoid section 35, an electromagnetic coil (not shown), a fixed iron core (not shown), a movable iron core (not shown) and so on are received within a casing 35*a*. A push rod 35*b* is connected to a tip end portion of the movable iron core. This push rod 35*b* is formed into a cylindrical rod shape. The push rod 35*b* includes a tip end portion abutted on an outer side surface of the second land portion 33*b* on a side of the solenoid section 35.

In the solenoid section 35, in a case where a pulse voltage is applied from an electric controller (not shown) to the electromagnetic coil, a thrust force according to the voltage value of the pulse voltage is acted to the movable iron core. With this, the solenoid section 35 is arranged to move the spool valve member 33 in forward and backward directions based on a relative difference between the thrust force of the movable iron core transmitted through the push rod 35*b*, and the spring force of the valve spring 34.

The electric controller is a controller using a PWM (pulse width modulation). The electric controller modulates a pulse width of the voltage applied to the electromagnetic coil. That is, the electric controller can continuously vary the voltage value of the voltage applied to the electromagnetic coil by varying the duty ratio.

By this configuration, in the electromagnetic switching valve 30, the sliding position of the spool valve member 33 is continuously controlled in accordance with the voltage value applied from the electric controller to the electromagnetic coil. Moreover, the electromagnetic switching valve 30 is arranged to switch the openings and closings of the introduction port 36 and the drain port 38, and to increase and decrease port opening areas in the opening state, in accordance with the sliding positon of the spool valve member 33.

Specifically, when the voltage applied from the electric controller to the electromagnetic coil of the solenoid section 35 is zero, that is, when the energization is not performed, the push rod 35*b* does not urge the spool valve member 33. Accordingly, as shown in FIG. 1, the spool valve member 33 is maximally urged by the spring force of the coil spring 34 in the downward direction.

In this case, the introduction port 36 is closed by the outer circumference surface of the first land portion 33*a*. The drain port 38 is connected to the annular passage 40 in a state where the opening area of the drain port 38 is maximized.

With this, the oil within the control hydraulic chamber 22 is discharged through the connection hole 23, the connection passage 25, the connection port 37, the annular passage 40, and the drain port 38 to the outside.

Figure 4:
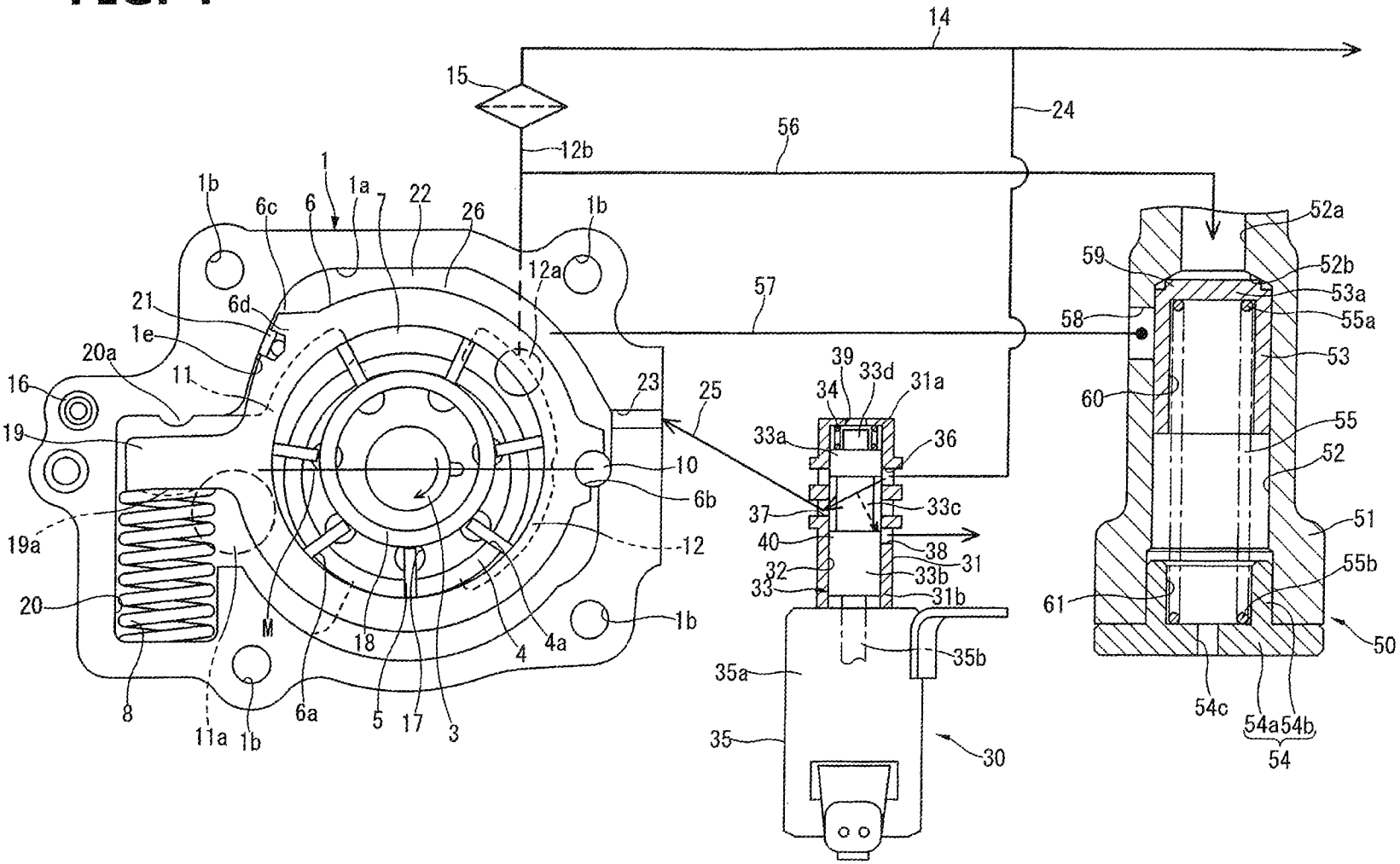
FIG. 4 is an operation explanation view of the variable displacement pump in a steady driving state of an engine.

On the other hand, when the voltage is applied from the electric controller to the electromagnetic coil, the spool valve member 33 is pushed by the push rod 35*b* to be moved in the upward direction of the drawing against the spring force of the valve spring 34, as shown in FIG. 4.

Accordingly, the closing of the introduction port 36 is released. The introduction port 36 is opened to the annular passage 40. On the other hand, a part of the drain port 38 is closed by the outer circumference surface of the second land portion 33*b*.

In this case, the opening area of the introduction port 36 is increased as the voltage applied from the electric controller to the electromagnetic coil is increased. On the other hand, the opening area of the drain port 38 is decreased as the voltage applied to the electromagnetic coil is increased. That is, the amount of the oil introduced through the introduction port 36 into the annular passage 40 is increased as the voltage applied to the electromagnetic coil is increased. On the other hand, the amount of the oil discharged through the drain port 38 is decreased as the voltage applied to the electromagnetic coil is increased.

The variable displacement oil pump is provided with a failsafe valve 50 which is a control valve arranged to regulate the discharge pressure when the main gallery pressure reaches a predetermined high pressure region in which the main gallery pressure is greater than a maximum required pressure $P_{max}$ required by the engine, and thereby to control the main gallery pressure.

As shown in FIG. 1, this failsafe valve 50 includes a valve housing 51 disposed and fixed on an outer side surface of the pump housing 1; a receiving hole 52 which has a circular cross section, and which is formed in the valve housing 51; a pressure sensitive valve member 53 provided within the receiving hole 52, and arranged to be slid in the axial direction; a sealing plug (closing plug) 54 closing the opening portion of the receiving hole 52 which is located on the one end side; and a control spring 55 elastically mounted between the sealing plug 54 and the pressure sensitive valve member 53.

The receiving hole 52 is connected to the discharge passage 12*b* through a discharge pressure introduction opening 52*a* which has a relatively small diameter, and which is formed in the upper end wall of the receiving hole 52. The discharge pressure is introduced from the discharge port 12 into the receiving hole 52.

Moreover, a supply port 58 is formed in a circumferential wall of the receiving hole 52 which is located on an axial one end side. The supply port 58 is formed in the radial direction to penetrate through the circumferential wall. The supply port 58 is connected through the connection passage 57 to the control hydraulic chamber 22.

Furthermore, the receiving hole 52 includes a seat surface 52*b* which has a stepped taper shape, and which is formed between the receiving hole 52 and the discharge pressure introduction opening 52*a*. When a pressure receiving portion 59 (described later) of the pressure sensitive valve member 53 is seated on the seat surface 52*b*, the receiving hole 52 and the discharge pressure introduction opening 52*a* are disconnected.

The pressure sensitive valve member 53 is formed into a cylindrical shape with a lid. The pressure sensitive valve member 53 includes one end portion which is located on a side of the discharge pressure introduction opening 52*a*, and which is closed by an end wall 53*a*. The pressure sensitive valve member 53 has an outside diameter slightly smaller than an inside diameter of the receiving hole 52. The pressure sensitive valve member 53 is slidably abutted on the receiving hole 52 with a minute clearance.

Moreover, the pressure sensitive valve member 53 includes a pressure receiving portion 59 which has a cylindrical shape having a diameter slightly smaller than an outside diameter of the pressure sensitive valve member 53, which is formed on an outer end side of the end wall 53*a* to protrude. This pressure receiving portion 59 includes a tip end surface formed into a flat shape, and arranged to receive the discharge pressure introduced from the discharge pressure introduction opening 52*a* to the receiving hole 52.

Furthermore, a control spring receiving chamber 60 is formed within the pressure sensitive valve member 53. The one end portion 55*a* of the control spring 55 is received and held within the control spring receiving chamber 60.

The sealing plug 54 includes a lid portion (cover portion) 54*a* which has a large diameter disc shape, and which closes the opening end of the receiving hole 52; and a cylindrical portion 54*b* which has a relatively small diameter, and which extends in the axial direction from an inner end surface of the lid portion 54*a*.

The lid portion 54*a* includes an air vent hole 54*c* which is formed at a substantially central position of the lid portion 54*a* to penetrate through the lid portion 54*a*, which is connected to the atmospheric pressure to ensure the good slidability of the pressure sensitive valve member 53, and which is for releasing a back pressure.

The cylindrical portion 54*b* has an outside diameter which is substantially identical to the inside diameter of the receiving hole 52 on the side of the opening portion. The cylindrical portion 54*b* is fixed within the receiving hole 52 by the press fit. The cylindrical portion 54*b* includes a control spring holding hole 61 which is formed within the cylindrical portion 54*b*, and which receives and holds the other end portion 55*b* of the control spring 55.

The control spring 55 includes the one end portion 55*a* elastically abutted on the inner end surface of the end wall 53*a*; and the other end portion 55*b* elastically abutted on the inner end surface of the lid portion 54*a* of the sealing plug 54. With this, the control spring 55 constantly urges the sensitive pressure valve member 53 toward the discharge pressure introduction opening 52*a*.

Operations of First Embodiment

Hereinafter, operations of the variable displacement oil pump according to the first embodiment are explained.

Firstly, the energization from the electric controller to the electromagnetic coil of the electromagnetic switching valve 30 is shut off in the low rotation region after the start of the engine. Accordingly, as shown in FIG. 1, the spool valve member 33 is not pressed by the push rod 35*b*, so that the spool valve member 33 is maximally urged by the valve spring 34 in the downward direction of the drawing.

Accordingly, the introduction port 36 is closed by the outer circumference surface of the first land portion 33*a* of the spool valve member 33. Consequently, the introduction port 36 and the connection port 37 are disconnected. On the other hand, the drain port 38 is connected to the connection port 37 in the maximum opening state.

With this, the control hydraulic chamber 22 is connected through the connection hole 23, the connection passage 25, the connection port 37, and the annular passage 40 to the drain port 38, so that the control hydraulic chamber 22 is opened to the outside. The hydraulic pressure is utterly acted to the control hydraulic chamber 22.

Accordingly, the cam ring 6 is rotated in the clockwise direction of FIG. 1 by the spring force of the coil spring 8. The cam ring 6 is held to a state where the upper surface of the arm 19 is abutted on the restriction protruding portion 20*a*, that is, the maximum eccentric state where the eccentric amount becomes maximum.

Figure 6:
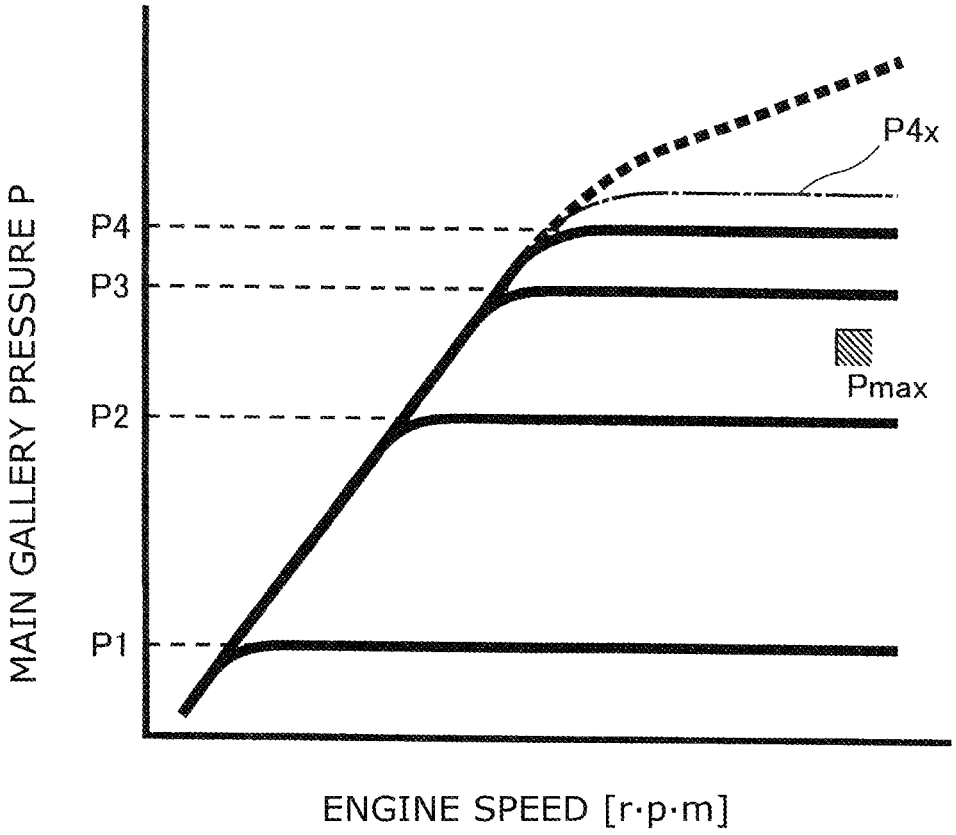
FIG. 6 is a characteristic diagram showing a relationship between a discharge pressure of the variable displacement oil pump according to the present embodiment, and an engine speed.

Consequently, the discharge pressure of the variable displacement oil pump at the non-actuation of the electromagnetic switching valve 30 is increased to be proportional to the increase of the engine speed. Accordingly, the main gallery pressure is increased to be proportional to the increase of the engine speed, as shown in FIG. 6.

When the main gallery pressure is increased to be equal to or greater than a predetermined value, the electromagnetic switching valve 30 is actuated to control the main gallery pressure in accordance with the required pressure of the engine.

For example, in a case where the hydraulic pressure is supplied from the main oil gallery 14 to the valve timing control device, the electric controller starts the energization to the electromagnetic coil of the electromagnetic switching valve 30 when the main gallery pressure reaches a predetermined low pressure P1 slightly higher than the required pressure of the valve timing control device. With this, as shown in FIG. 4, the spool valve member 33 is pressed by the push rod 35*b* to be moved in the upward direction of the drawing against the spring force of the valve spring 34.

Consequently, the closing of the introduction port 36 by the first land portion 33*a* is partially released. The introduction port 36 is connected to the connection port 37 in a state where the opening area of the introduction port 36 is throttled. On the other hand, the drain port 38 is connected to the connection port 37 by an opening area smaller than the opening area of the introduction port 36 by the outer circumference surface of the second land portion 33*b*.

With this, the amount of the oil introduced from the introduction port 36 to the annular passage 40 becomes greater than the amount of the oil discharged from the annular passage 40 through the drain port 38. Accordingly, a part of the oil introduced from the introduction port 36 is supplied through the connection port 37, the connection passage 25, and the connection hole 23 to the control hydraulic chamber 22.

Accordingly, the hydraulic pressure of the oil supplied to the control hydraulic chamber 22 is acted to the pressure receiving surface 26 of the cam ring 26, so that the cam ring 6 is urged in the concentric direction against the spring force of the coil spring 8. Consequently, the main oil gallery pressure is suppressed from becoming equal to or greater than the low pressure P1.

On the other hand, when the main oil gallery pressure becomes smaller than the low pressure P1 in accordance with the decrease of the eccentric amount of the cam ring 6, the voltage applied from the electric controller to the electromagnetic coil is slightly decreased, so that the spool valve member 33 is slightly moved from the state of FIG. 4 in the downward direction.

Accordingly, the opening area of the introduction port 36 is decreased. On the other hand, the opening area of the drain port 38 is increased. With these, the oil supplied to the control hydraulic chamber 22 is decreased.

Consequently, the hydraulic pressure within the control hydraulic chamber 22 is decreased, so that the eccentric amount of the cam ring 6 is increased. Therefore, the main gallery pressure is increased again.

In this way, the variable displacement oil pump is arranged to increase and decrease the opening areas of the introduction port 36 and the drain port 38 in accordance with the sliding movement of the spool valve member 33, to increase and decrease the internal pressure of the control hydraulic chamber 22, and thereby to regulate the main gallery pressure to the low pressure P1, as shown in FIG. 6.

Besides, in a case where the main gallery pressure is regulated to the low pressure P1, the hydraulic pressure decreased to be slightly smaller than the low pressure P1 due to the passage pressure loss (drop) and so on is supplied to the control hydraulic chamber 22. However, the set load of the coil sprig 8 is previously set to be actuated when the internal pressure of the control hydraulic chamber 22 becomes equal to or greater than the predetermined set pressure lower than the low pressure P1, as described above. Accordingly, it is possible to perform the pressure regulation by the cam ring 6 without being influenced due to the passage pressure loss and so on.

Moreover, for example, in a case where the hydraulic pressure is supplied from the main oil gallery 14 to the oil jet, the electric controller starts the energization to the electromagnetic coil of the electromagnetic switching valve 30 when the main oil gallery pressure reaches a predetermined middle pressure P2 which is slightly higher than the required pressure of the oil jet.

The variable displacement oil pump is controlled by the electromagnetic switching vale 30 so that the main gallery pressure is held to the middle pressure P2. This control method and operation are identical to those when the main gallery pressure is controlled to the low pressure P1.

Moreover, for example, in a case where the hydraulic pressure is supplied from the main oil gallery 14 to the bearing portion of the crank shaft which needs highest hydraulic pressure in the engine, the electric controller starts the energization to the electromagnetic coil of the electromagnetic switching valve 30 when the main gallery pressure reaches a predetermined high pressure P3 slightly higher than the maximum required pressure $P_{max}$ which is the required pressure of the bearing portion.

Then, the variable displacement oil pump is controlled by the electromagnetic switching valve 30 so that the main gallery pressure is held to the high pressure P3. This control method and operation are identical to those when the main gallery pressure is controlled to the low pressure P1.

As described above, in this embodiment, the electric controller controls the voltage applied to the electromagnetic coil of the electromagnetic switching valve 30. With this, it is possible to stably control the main gallery pressure to the arbitrary pressure such as the low pressure P1 and the high pressure P3.

Moreover, in this embodiment, when the energization from the electric controller to the electromagnetic coil is shut off due to the failure of the electromagnetic switching valve 30 due to the breaking and so on, the spool valve member 33 is not pressed by the push rod 35*b*, the spool valve member 33 is constantly maximally urged in the downward direction of the drawing, as shown in FIG. 1.

With this, the introduction port 36 and the connection port 37 are disconnected by the first land portion 33*a* of the spool valve member 33. On the other hand, the connection port 37 and the drain port 38 are connected. Accordingly, the oil is not supplied to the control hydraulic chamber 22, so that the cam ring 6 is constantly positioned at the maximum eccentric position.

Accordingly, as shown by a broken line of FIG. 6, the pump has a hydraulic pressure characteristic in which the main oil gallery pressure is gradually increased in accordance with the increase of the engine speed. In this embodiment, when the main gallery pressure reaches a high pressure P4 higher than the maximum required pressure $P_{max}$, the failsafe valve 50 is actuated to adjust the main gallery pressure.

Figure 5:
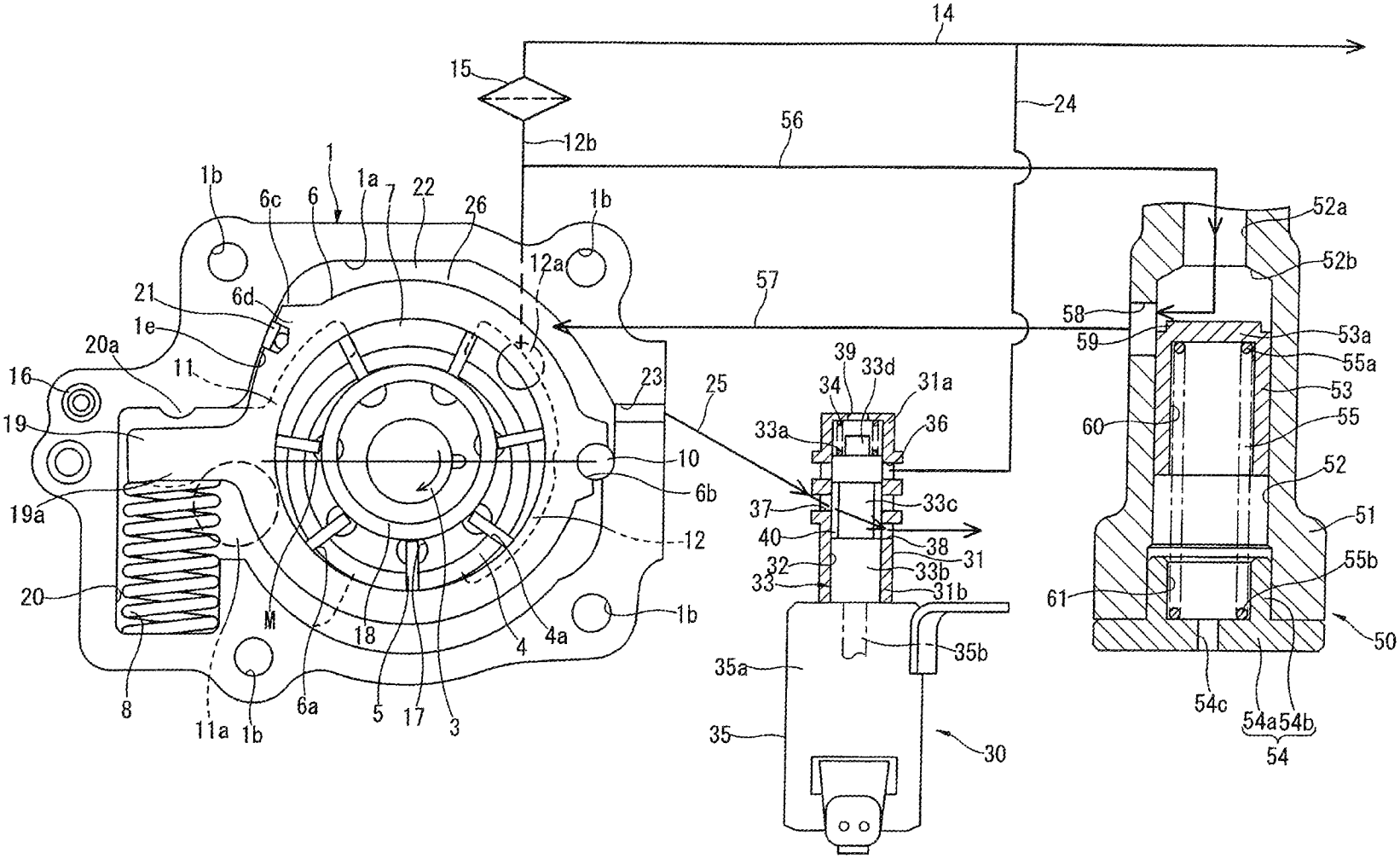
FIG. 5 is an operation explanation view of the variable displacement oil pump when an electromagnetic switching valve is failed.

That is, in the failsafe valve 50, when the engine speed is low and the discharge pressure acted to the pressure receiving portion 59 is small, the tip end edge of the pressure receiving portion 59 is held to be seated on the seat surface 52*b* by the spring force of the control spring 55, as shown in FIG. 1 and FIG. 4. However, when the discharge pressure reaches the high pressure P4x (cf. one dot chain line in FIG. 6) slightly higher than the high pressure P4 in accordance with the increase of the engine speed, the high pressure P4x is acted to the pressure receiving portion 59, so that the pressure sensitive valve member 53 is moved toward the sealing plug 54 against the spring force of the control spring 55, as shown in FIG. 5.

With this, the discharge pressure introduction opening 52*a* and the supply port 58 are connected with each other. Consequently, the oil discharged from the discharge port 12 is supplied to the control hydraulic chamber 22 through the discharge pressure introduction opening 52*a*, the receiving hole 52, the supply port 58, and the connection passage 57.

In this case, a part of the oil supplied to the control hydraulic chamber 22 is discharged from the drain port 38 through the connection hole 23, the connection passage 25, and so on to the outside. However, most of the oil supplied to the control hydraulic chamber 22 is remained within the control hydraulic chamber 22. Accordingly, the internal pressure of the control hydraulic chamber 22 is increased. Consequently, the cam ring 6 is moved in the concentric direction against the spring force of the coil spring 8, as shown in FIG. 5. Therefore, the discharge pressure is suppressed from becoming equal to or greater than the high pressure P4x.

On the other hand, when the discharge pressure becomes smaller than the high pressure P4x in accordance with the decrease of the eccentric amount of the cam ring 6, the force acted to the pressure receiving portion 59 is decreased. Accordingly, the pressure sensitive valve member 53 is pressed by the control spring 55 to be slightly moved from the state of FIG. 4 in the upward direction.

Consequently, the opening area of the supply port 58 is decreased, so that the oil supplied to the control hydraulic chamber 22 is decreased. Therefore, the hydraulic pressure within the control hydraulic chamber 22 is decreased, so that the eccentric amount of the cam ring 6 is increased. Accordingly, the discharge pressure is increased again.

As described above, the variable displacement oil pump is arranged to increase and decrease the opening area of the supply port 58 by the slight sliding movement of the sensitive pressure valve member 53 according to the variation of the discharge pressure, to increase and decrease the internal pressure of the control hydraulic pressure 22, thereby to regulate the discharge pressure to the high pressure P4x, and to regulate the main gallery pressure to the high pressure P4, as shown in FIG. 6.

Accordingly, in this embodiment, it is possible to suppress the excessive increases of the discharge pressure and the main gallery pressure even when the electromagnetic switching valve 30 is failed, and so on. Therefore, it is possible to decrease the risk such as the breakage of the oil filter 15, and the failure of the variable displacement oil pump due to the excessive hydraulic pressure.

Moreover, the main gallery pressure is not decreased to be lower than the maximum required pressure $P_{max}$ at the predetermined high rotation although the excessive increases of the discharge pressure and the main gallery pressure are suppressed. Accordingly, even when the electromagnetic switching valve 30 is failed, it is possible to continuously perform the lubrication of the bearing portion of the crank shaft.

Second Embodiment

Figure 7:
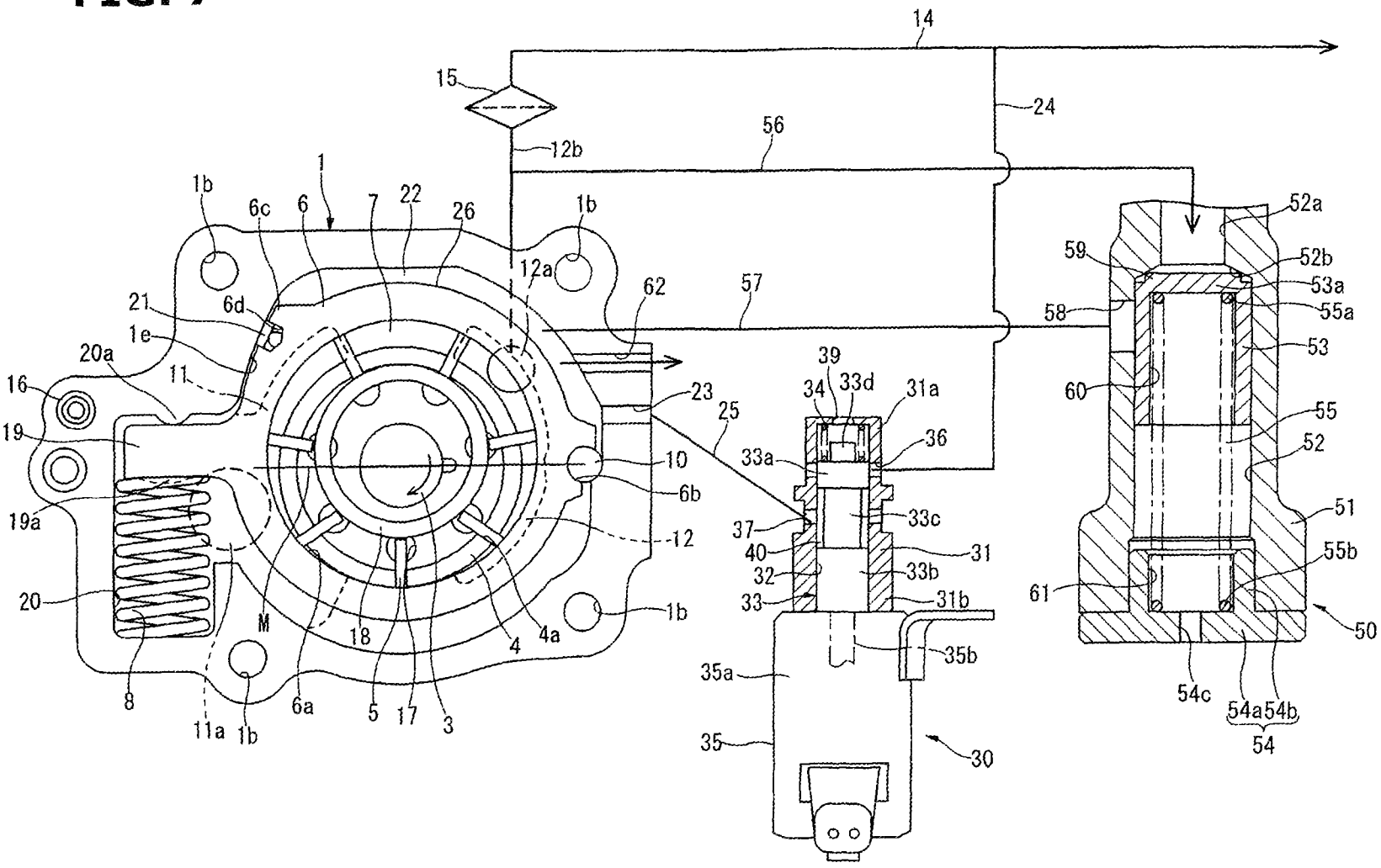
FIG. 7 is an operation explanation view showing a variable displacement oil pump according to a second embodiment at a low engine speed.
Figure 8:
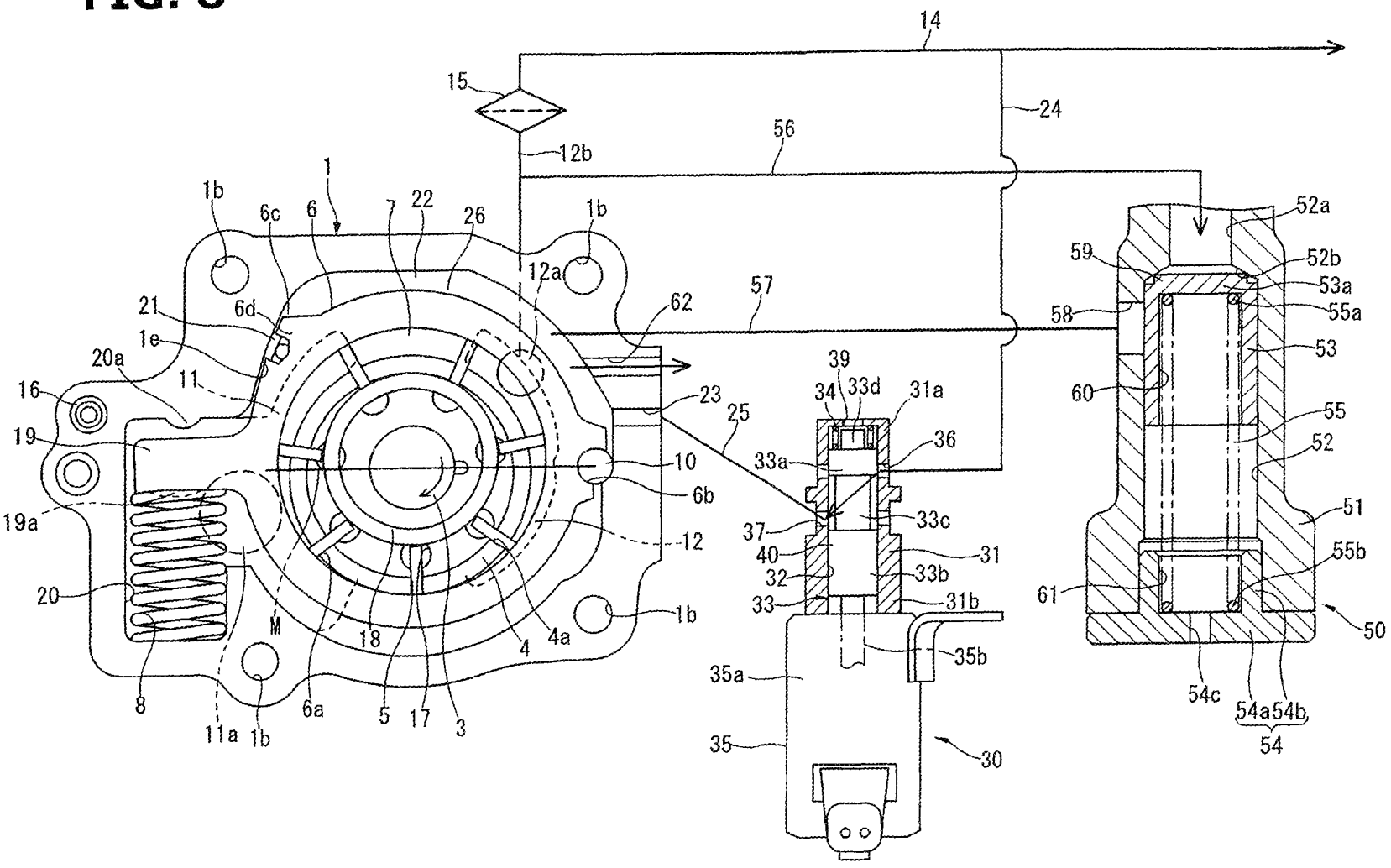
FIG. 8 is an operation explanation view when a discharge pressure of the variable displacement oil pump is controlled to a predetermined value.

FIG. 7 and FIG. 8 show a second embodiment according to the present invention. The second embodiment has a basic configuration identical to that of the first embodiment. Accordingly, common configurations have the same numerals. Concrete explanations are omitted.

As shown in FIG. 7, in the electromagnetic switching valve 30 according to this embodiment, the drain port 38 of the valve body 31 is omitted. There are only two ports of the introduction port 36 and the connection port 37.

In this embodiment, the housing 2 includes a drain port 62 which is a drain mechanism arranged to discharge the oil within the control hydraulic chamber 22, in place of the omitted drain port 38. This drain port 62 is formed to penetrate through the circumferential wall of the pump housing 1 constituting the control hydraulic chamber 22. This drain port 62 connects the control hydraulic chamber 22 and the atmospheric pressure outside the pump. Besides, the drain port 62 may connect the control hydraulic chamber 22 to the suction port 11, in place of the atmospheric pressure.

Operation of Second Embodiment

Accordingly, in the variable displacement oil pump, the oil within the control hydraulic chamber 22 is constantly discharged from the drain port 62. However, the variable displacement oil pump can obtain the hydraulic pressure characteristic identical to the hydraulic pressure characteristic of the main gallery pressure in the first embodiment shown in FIG. 6, by adjusting the position control of the spool valve member 33 of the electromagnetic switching valve 30.

That is, the energization from the electric controller to the electromagnetic coil of the electromagnetic switching valve 30 is shut off in the low rotation region after the start of the engine. Accordingly, the spool valve member 33 is not pressed by the push rod 35*b* as shown in FIG. 7. The spool valve member 33 is maximally urged by the valve spring 33 in the downward direction of the drawing. Accordingly, the introduction port 36 is closed by the outer circumference surface of the first land portion 33*a* of the spool valve member 33, so that the introduction port 36 and the connection port 37 are disconnected.

With this, the oil is not supplied to the control hydraulic chamber 22, so that the hydraulic pressure is not utterly acted to the pressure receiving surface 26.

Accordingly, the cam ring 6 is rotated in the clockwise direction of FIG. 7 by the spring force of the coil spring 8. The cam ring 6 is held to a state where the upper surface of the arm 19 is abutted on the restriction protruding portion 20*a*, that is, the maximum eccentric state where the eccentric amount becomes maximum.

Consequently, the discharge pressure of the variable displacement oil pump at the non-actuation of the electromagnetic switching valve 30 is increased to be proportional to the increase of the engine speed. Accordingly, the main gallery pressure is increased to be proportional to the increase of the engine speed, as shown in FIG. 6.

When the main gallery pressure is increased to be equal to or greater than a predetermined value, the electromagnetic switching valve 30 is actuated to control the main gallery pressure to the arbitrary pressure such as the low pressure P1, the middle pressure P2, and the high pressure P3 in accordance with the required pressure of the engine.

Hereinafter, the pressure regulation control of the main gallery pressure is different only in the voltage value of the voltage applied from the electric controller to the electromagnetic coil, and the applying timing. Accordingly, only the case where the main gallery pressure is regulated to the low pressure P1 is explained. The other cases are omitted.

In a case where the main oil gallery pressure is regulated to the low pressure P1, the electric controller starts the energization to the electromagnetic coil of the electromagnetic switching valve 30 when the main gallery pressure reaches the low pressure P1. With this, as shown in FIG. 8, the spool valve member 33 is pressed by the push rod 35*b* to be moved in the upward direction of the drawing against the spring force of the valve spring 34, so that the introduction port 36 is connected to the connection port 37.

In this case, when the opening area of the introduction port 36 becomes equal to or greater than a predetermined value in accordance with the sliding movement of the spool valve member 33, the amount of the oil supplied through the introduction port 36 to the control hydraulic chamber 22 becomes greater than the amount of the oil discharged from the control hydraulic chamber 22 to the drain port 62. With this, a part of the oil supplied from the introduction port 36 through the connection port 37, the connection passage 25, and the connection hole 23 to the control hydraulic chamber 22 is remained within the control hydraulic chamber 22.

Accordingly, the hydraulic pressure of the oil remained in the control hydraulic chamber 22 is acted to the pressure receiving surface 26 of the cam ring 26, so that the cam ring 6 is urged in the concentric direction against the spring force of the coil spring 8. Consequently, the main oil gallery pressure is suppressed from becoming equal to or greater than the low pressure P1.

On the other hand, when the main oil gallery pressure becomes smaller than the low pressure P1 in accordance with the decrease of the eccentric amount of the cam ring 6, the voltage applied from the electric controller to the electromagnetic coil is slightly decreased, so that the spool valve member 33 is slightly moved from the state of FIG. 8 in the downward direction.

Accordingly, the opening area of the introduction port 36 is decreased. With this, the oil remained in the control hydraulic chamber 22 is also decreased. Consequently, the hydraulic pressure within the control hydraulic chamber 22 is decreased, so that the eccentric amount of the cam ring 6 is increased. Therefore, the main gallery pressure is increased again.

In this way, the variable displacement oil pump is arranged to increase and decrease the opening areas of the introduction port 36 in accordance with the sliding movement of the spool valve member 33, to increase and decrease the internal pressure of the control hydraulic chamber 22, and thereby to regulate the main gallery pressure to the low pressure P1, as shown in FIG. 6.

Besides, in this embodiment, it is also possible to perform the failsafe by the failsafe valve 50 when the electromagnetic switching valve 30 is failed, and so on. The configuration and the operation of the failsafe valve 50 are identical to those in the first embodiment. Accordingly, concrete explanations are omitted.

Accordingly, in this embodiment, even in a case where the drain port 62 arranged to discharge the oil within the control hydraulic chamber 22 is formed in the pump housing 1, it is possible to obtain the hydraulic characteristics and the effects which are identical to those of the first embodiment. With this, it is possible to improve the freedom of the layout when the variable displacement oil pump is assembled to the vehicle and so on.

Third Embodiment

Figure 9:
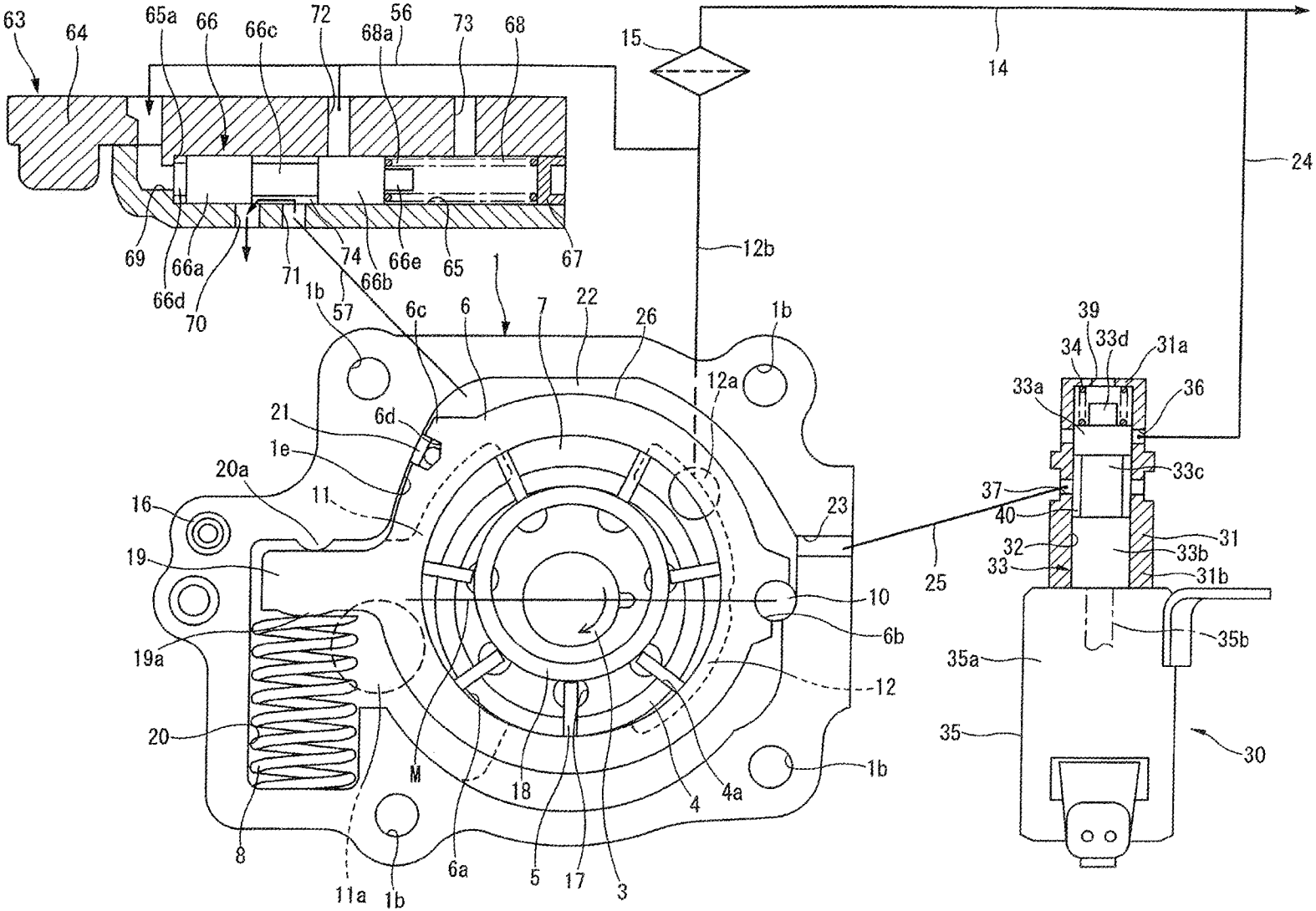
FIG. 9 is an operation explanation view showing a variable displacement oil pump according to a third embodiment at a low engine speed.
Figure 10:
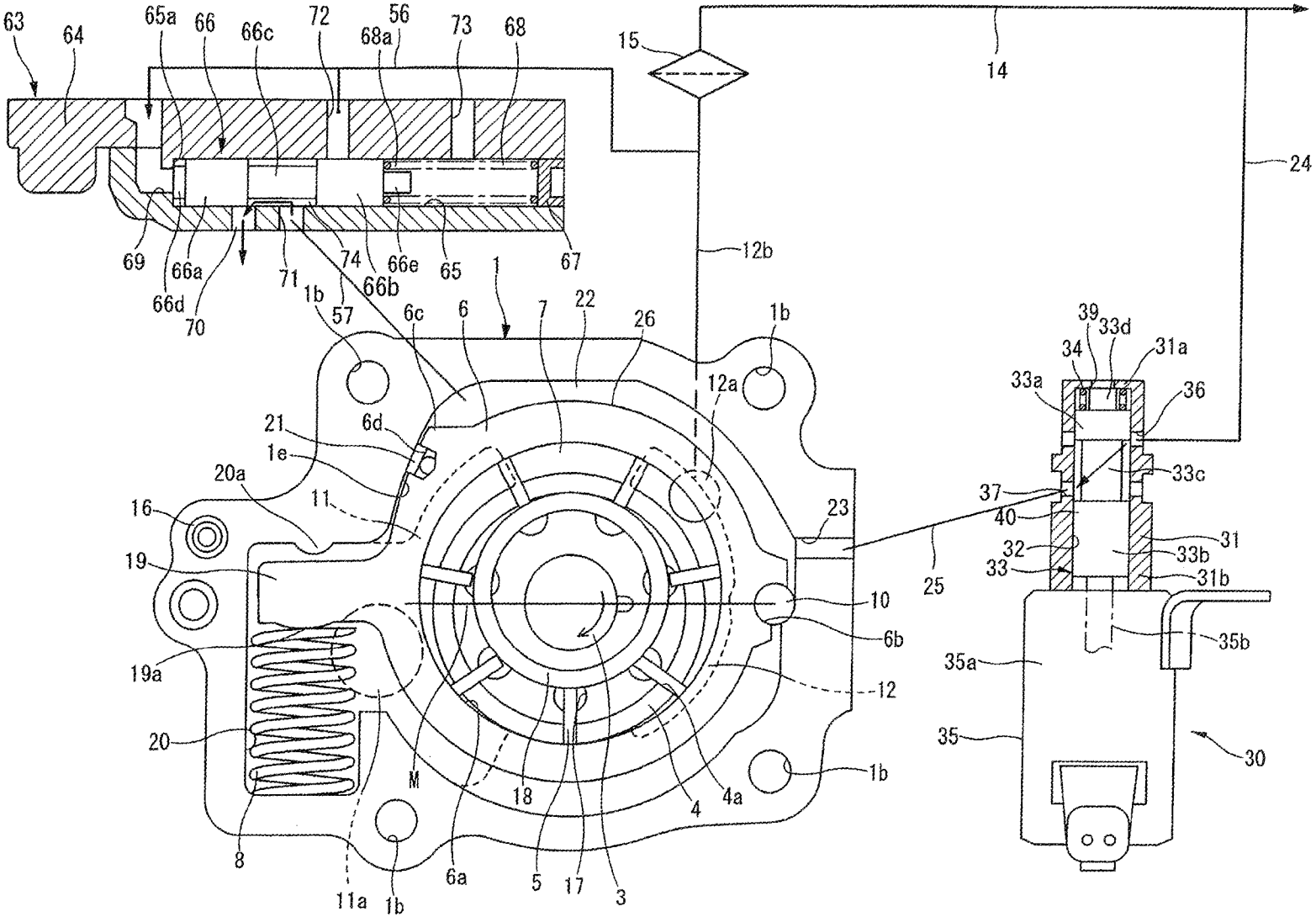
FIG. 10 is an operation explanation view when a discharge pressure of the variable displacement oil pump is controlled to a predetermined value.

FIG. 9 to FIG. 10 show a third embodiment according to the present invention. The third embodiment has a basic configuration identical to that of the first embodiment. However, the failsafe valve 50 in the first embodiment is varied to a failsafe valve 63 which is a control valve of a pilot type. Moreover, the drain port 38 of the electromagnetic switching valve 30 is omitted. The failsafe valve 63 includes a drain port 70 which is a drain mechanism arranged to discharge the oil within the control hydraulic chamber 22.

That is, as shown in FIG. 9, the failsafe valve 63 includes a valve housing 64 disposed and fixed on an outer side surface of the pump housing 1; a receiving hole 65 which has a circular cross section, and which is formed in the valve housing 64; a spool valve member 66 provided within the receiving hole 65 to be slid in an axial direction; a plug 67 which has a bowl shape, and which is fixed in one end side opening portion of the receiving hole 65 by the press fit; and a control spring 68 elastically mounted between the plug 67 and the spool valve member 66.

The receiving hole 65 is connected to the discharge passage 12*b* through the discharge pressure introduction passage 56 and a pilot pressure introduction opening 69 which is formed in an end wall on a left side in FIG. 9, and which has a relatively small diameter. The discharge pressure serving as the pilot pressure is introduced from the discharge passage 12*b* to the receiving hole 65.

Moreover, a circumferential wall of the receiving hole 65 includes a drain port 70 connected to the atmospheric pressure of the outside; a connection port 71 connected through the connection passage 57 to the control hydraulic chamber 22; a discharge pressure introduction port 72 connected through the discharge pressure introduction passage 56 to the discharge passage 12*b*; and an air vent hole 73 arranged to ensure a good slidability of the spool valve member 66. Each of the drain port 70, the connection port 71, the discharge pressure introduction port 72, and the air vent hole 73 is formed to penetrate in the radial direction. The drain port 70, the connection port 71, the discharge pressure introduction port 72, and the air vent hole 73 are formed in this order from the pilot pressure introduction opening 69's side to the plug 67's side. Besides, the drain port 70 may be formed to be connected to the suction port 11, in place of the atmospheric pressure.

Furthermore, the receiving hole 65 includes a seat surface 65*a* which has a stepped shape, and which is formed between the pilot pressure introduction hole 69 and the receiving hole 65. When a pressure receiving portion 66*d* (described later) of the spool valve member 66 is seated on the seat surface 65*a*, the discharge pressure introduction port 72 and the connection port 71 are disconnected.

The spool valve member 66 includes a first land portion 66*a* which is formed on a side of the pilot pressure introduction opening 69, and which has a large diameter cylindrical shape; a second land portion 66*b* which is formed on a side of the plug 67, and which has a large diameter cylindrical shape; and a small diameter shaft portion 66*c* which connects the both land portions 66*a* and 66*b*, and which has a relatively small diameter cylindrical shape.

The first and second land portions 66*a* and 66*b* have the same outside diameter. The first and second land portions 66*a* and 66*b* are slid with minute clearances on an inner circumference surface of the receiving hole 65.

An annular passage 74 is separated on the outer circumference side of the small diameter shaft portion 66*c* by the outer circumference surface of the small diameter shaft portion 66*c*, the inner circumference surface of the receiving hole 65, and the inner side surfaces of the first and second land portions 66*a* and 66*b* which confront each other. The oil flows within the annular passage 74. The connection port 71 is constantly connected to the annular passage 74 in the maximally opened state, irrespective of the sliding position of the spool valve member 66. On the other hand, the drain port 70 and the discharge pressure introduction port 72 are connected to the annular passage 74 in accordance with the sliding position of the spool valve member 66.

Moreover, a pressure receiving portion 66*d* is provided on an end surface of the first land portion 66*a* on a side of the pilot pressure introduction opening 69 to protrude. The pressure receiving portion 66*d* has a relatively small cylindrical shape. This pressure receiving portion 66*d* includes a tip end surface which has a flat shape, and which serves as a pressure receiving surface. This pressure receiving surface of the pressure receiving portion 66*d* receives the pilot pressure supplied from the discharge passage 12*b* through the discharge pressure introduction passage 56 to the pilot pressure introduction opening 69.

Furthermore, a protrusion 66*e* is provided on an end surface of the second land portion 66*b* on a side of the plug 67. The protrusion 66*e* has a small diameter cylindrical shape. The protrusion 66*e* elastically holds one end portion 68*a* of the control spring 68.

The electromagnetic switching valve 30 has the configuration and the connection relationship which are identical to those of the second embodiment. Accordingly, the explanations are omitted.

Operation of Third Embodiment

Hereinafter, operations of the variable displacement oil pump according to the third embodiment are explained.

Firstly, the energization from the electric controller to the electromagnetic coil of the electromagnetic switching valve 30 is shut off in the low rotation region after the start of the engine. Accordingly, the spool valve member 33 is not pressed by the push rod 35*b* as shown in FIG. 9. The spool valve member 33 is maximally urged by the valve spring 33 in the downward direction of the drawing. Accordingly, the introduction port 36 is closed by the outer circumference surface of the first land portion 33*a* of the spool valve member 33, so that the introduction port 36 and the connection port 37 are disconnected. Consequently, the oil is not supplied to the control hydraulic chamber 22.

In this case, the control hydraulic chamber 22 is connected through the connection passage 57, the connection port 71, the annular passage 74, and the drain port 70 to the outside of the pump. Accordingly, the hydraulic pressure is utterly not acted to the pressure receiving surface 26.

Accordingly, the cam ring 6 is rotated in the clockwise direction of FIG. 9 by the spring force of the coil spring 8. The cam ring 6 is held to a state where the upper surface of the arm 19 is abutted on the restriction protruding portion 20*a*, that is, the maximum eccentric state where the eccentric amount becomes maximum.

Consequently, the discharge pressure of the variable displacement oil pump at the non-actuation of the electromagnetic switching valve 30 is increased to be proportional to the increase of the engine speed. Accordingly, the main gallery pressure is increased to be proportional to the increase of the engine speed, as shown in FIG. 6.

When the main gallery pressure is increased to be equal to or greater than a predetermined value, the electromagnetic switching valve 30 is actuated to control the main gallery pressure to the arbitrary pressure such as the low pressure P1, the middle pressure P2, and the high pressure P3 in accordance with the required pressure of the engine.

Hereinafter, the pressure regulation control of the main gallery pressure is different only in the voltage value of the voltage applied from the electric controller to the electromagnetic coil, and the applying timing. Accordingly, only the case where the main gallery pressure is regulated to the low pressure P1 is explained. The other cases are omitted.

In a case where the main oil gallery pressure is regulated to the low pressure P1, the electric controller starts the energization to the electromagnetic coil of the electromagnetic switching valve 30 when the main gallery pressure reaches the low pressure P1. With this, as shown in FIG. 10, the spool valve member 33 is pressed by the push rod 35*b* to be moved in the upward direction of the drawing against the spring force of the valve spring 34, so that the introduction port 36 is connected to the connection port 37.

In this case, when the opening area of the introduction port 36 becomes equal to or greater than a predetermined value in accordance with the sliding movement of the spool valve member 33, the amount of the oil supplied through the introduction port 36 to the control hydraulic chamber 22 becomes greater than the amount of the oil discharged from the control hydraulic chamber 22 through the connection passage 57, the connection port 71, the annular passage 74, and the drain port 70 to the outside. With this, a part of the oil supplied from the introduction port 36 through the connection port 37, the connection passage 25, and the connection hole 23 to the control hydraulic chamber 22 is remained within the control hydraulic chamber 22.

Accordingly, the hydraulic pressure of the oil remained in the control hydraulic chamber 22 is acted to the pressure receiving surface 26 of the cam ring 26, so that the cam ring 6 is urged in the concentric direction against the spring force of the coil spring 8. Consequently, the main oil gallery pressure is suppressed from becoming equal to or greater than the low pressure P1.

On the other hand, when the main oil gallery pressure becomes smaller than the low pressure P1 in accordance with the decrease of the eccentric amount of the cam ring 6, the voltage applied from the electric controller to the electromagnetic coil is slightly decreased, so that the spool valve member 33 is slightly moved from the state of FIG. 10 in the downward direction.

Accordingly, the opening area of the introduction port 36 is decreased. With this, the oil remained in the control hydraulic chamber 22 is also decreased. Consequently, the hydraulic pressure within the control hydraulic chamber 22 is decreased, so that the eccentric amount of the cam ring 6 is increased. Therefore, the pump discharge pressure and the main gallery pressure are increased again.

In this way, the variable displacement oil pump is arranged to increase and decrease the opening areas of the introduction port 36 in accordance with the sliding movement of the spool valve member 33, to increase and decrease the internal pressure of the control hydraulic chamber 22, and thereby to regulate the main gallery pressure to the low pressure P1, as shown in FIG. 6.

Figure 11:
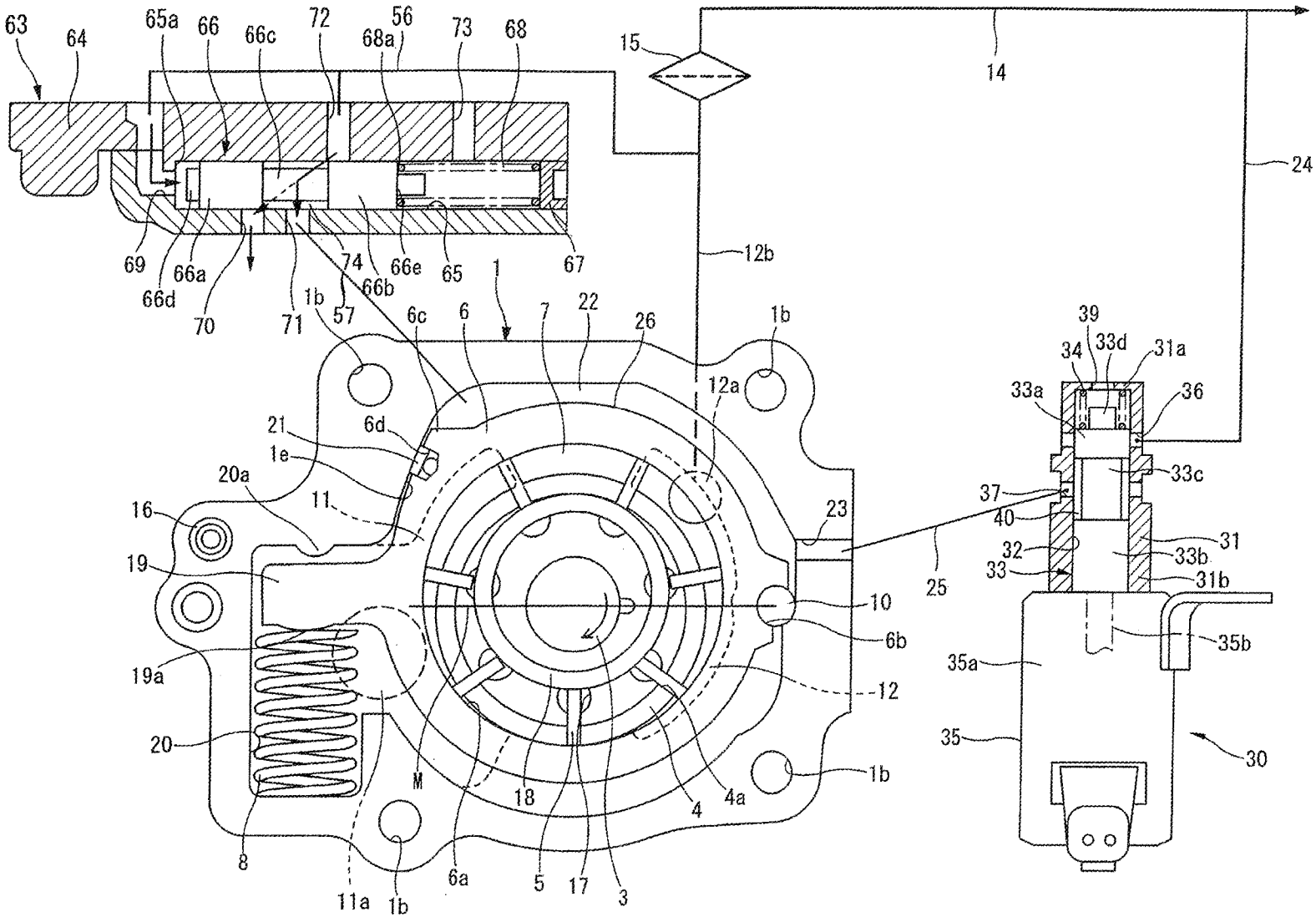
FIG. 11 is an operation explanation view of the variable displacement oil pump when an electromagnetic switching valve is failed.

Moreover, when the electromagnetic switching valve 30 is failed due to the breaking and so on, the energization from the electric controller to the electromagnetic coil is shut off. Accordingly, the spool valve member 33 is not pressed by the push rod 35*b*, the spool valve member 33 is constantly maximally urged in the downward direction of the drawing, as shown in FIG. 11.

With this, the introduction port 36 and the connection port 37 are disconnected by the first land portion 33*a* of the spool valve member 33. Accordingly, the oil is not supplied to the control hydraulic chamber 22, so that the cam ring 6 is constantly positioned at the maximum eccentric position.

Accordingly, as shown by a broken line of FIG. 6, the variable displacement oil pump has a hydraulic pressure characteristic in which the main oil gallery pressure is gradually increased in accordance with the increase of the engine speed. When the main gallery pressure reaches a high pressure P4 higher than the maximum required pressure $P_{max}$, the failsafe valve 63 is actuated to adjust the main gallery pressure.

Specifically, in the failsafe valve 63, when the engine speed is low and the discharge pressure (the pilot pressure) acted to the pressure receiving portion 66*d* is small, the tip end edge of the pressure receiving portion 66*d* is held to be seated on the seat surface 65*a* by the spring force of the control spring 68, as shown in FIG. 9. However, when the discharge pressure reaches the high pressure P4x slightly higher than the high pressure P4 in accordance with the increase of the engine speed, the high pressure P4x is acted to the pressure receiving portion 66*d*, so that the spool valve member 66 is moved toward the plug 67 against the spring force of the control spring 68, as shown in FIG. 11.

With this, the discharge pressure introduction port 72 and the connection port 71 are connected with each other. Consequently, the oil discharged from the discharge port 12 is supplied to the control hydraulic chamber 22 through the discharge pressure introduction passage 56, the discharge pressure introduction port 72, the annular passage 74, the connection port 71, and the connection passage 57.

In this case, the connection state between the annular passage 74 and the drain port 70 is continued. However, most of the drain port 70 is closed by the outer circumference surface of the first land portion 66*a* of the spool valve member 66. Most of the oil introduced into the annular passage 74 is not discharged to the outside. The most of the oil introduced into the annular passage 74 is supplied to the control hydraulic chamber 22, so that the internal pressure of the control hydraulic chamber 22 is increased. Accordingly, the internal pressure of the control hydraulic chamber 22 is increased. Consequently, the cam ring 6 is moved in the concentric direction against the spring force of the coil spring 8, as shown in FIG. 11. Therefore, the discharge pressure is suppressed from becoming equal to or greater than the high pressure P4x.

On the other hand, when the discharge pressure becomes smaller than the high pressure P4x in accordance with the decrease of the eccentric amount of the cam ring 6, the force acted to the pressure receiving portion 66*d* is decreased. Accordingly, the spool member 66 is pressed by the control spring 68 to be slightly moved from the state of FIG. 11 in the leftward direction of the drawing.

Consequently, the opening area of the discharge pressure introduction port 72 with respect to the annular passage 74 is decreased. On the other hand, the opening area of the drain port 70 with respect to the annular passage 74 is increased. Accordingly, the oil supplied to the control hydraulic chamber 22 is decreased. Therefore, the hydraulic pressure within the control hydraulic chamber 22 is decreased, so that the eccentric amount of the cam ring 6 is increased. Accordingly, the discharge pressure is increased again.

As described above, the variable displacement oil pump is arranged to increase and decrease the opening areas of the drain port 70 and the discharge pressure introduction port 72 by the slight sliding movement of the spool valve member 66 according to the variation of the discharge pressure, to increase and decrease the internal pressure of the control hydraulic pressure 22, thereby to regulate the discharge pressure to the high pressure P4x, and to regulate the main gallery pressure to the high pressure P4, as shown in FIG. 6.

Accordingly, in this embodiment, it is also possible to attain the hydraulic characteristics and the effects which are identical to those of the first embodiment.

Fourth Embodiment

Figure 12:
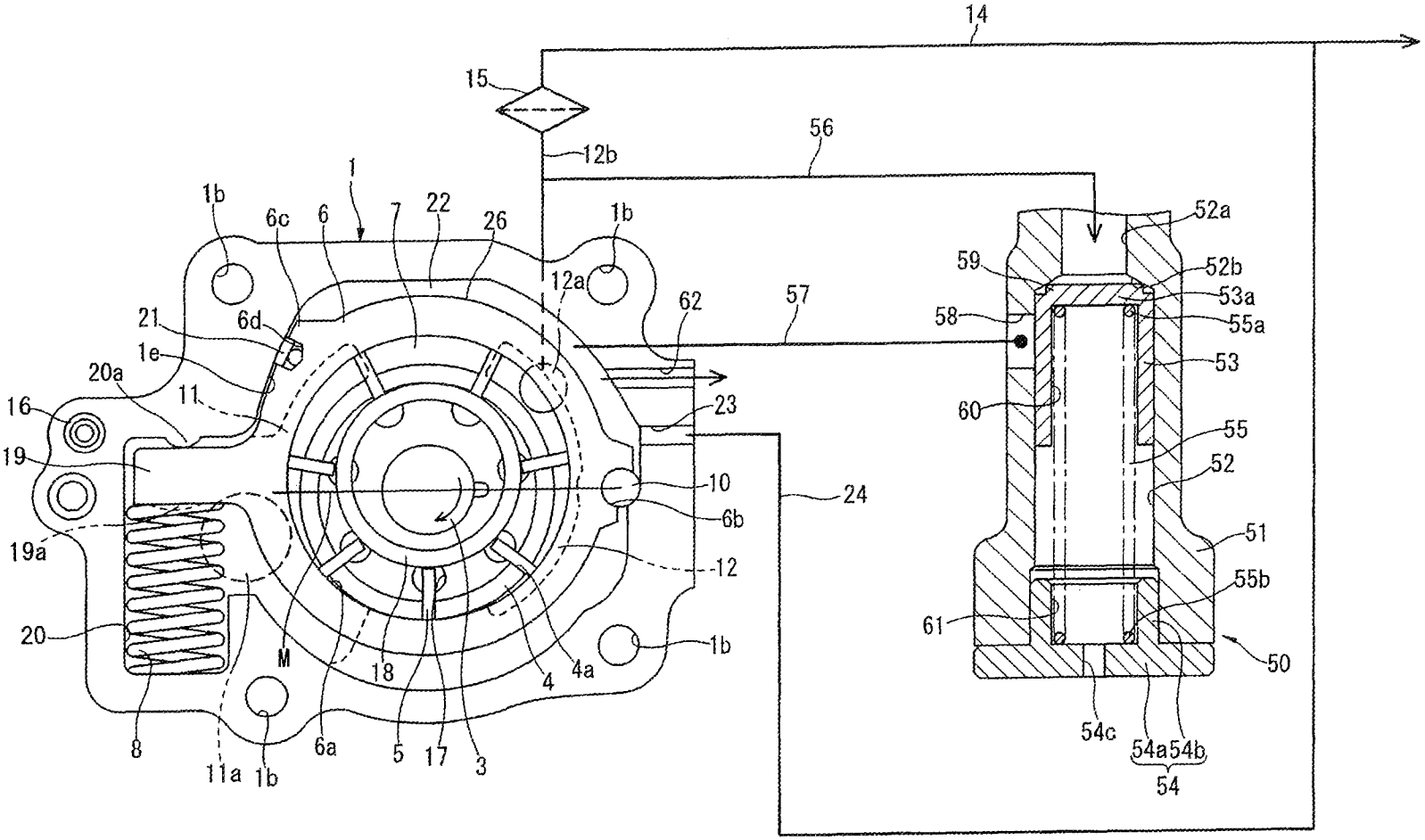
FIG. 12 is a schematic view showing a variable displacement oil pump according to a fourth embodiment.
Figure 13:
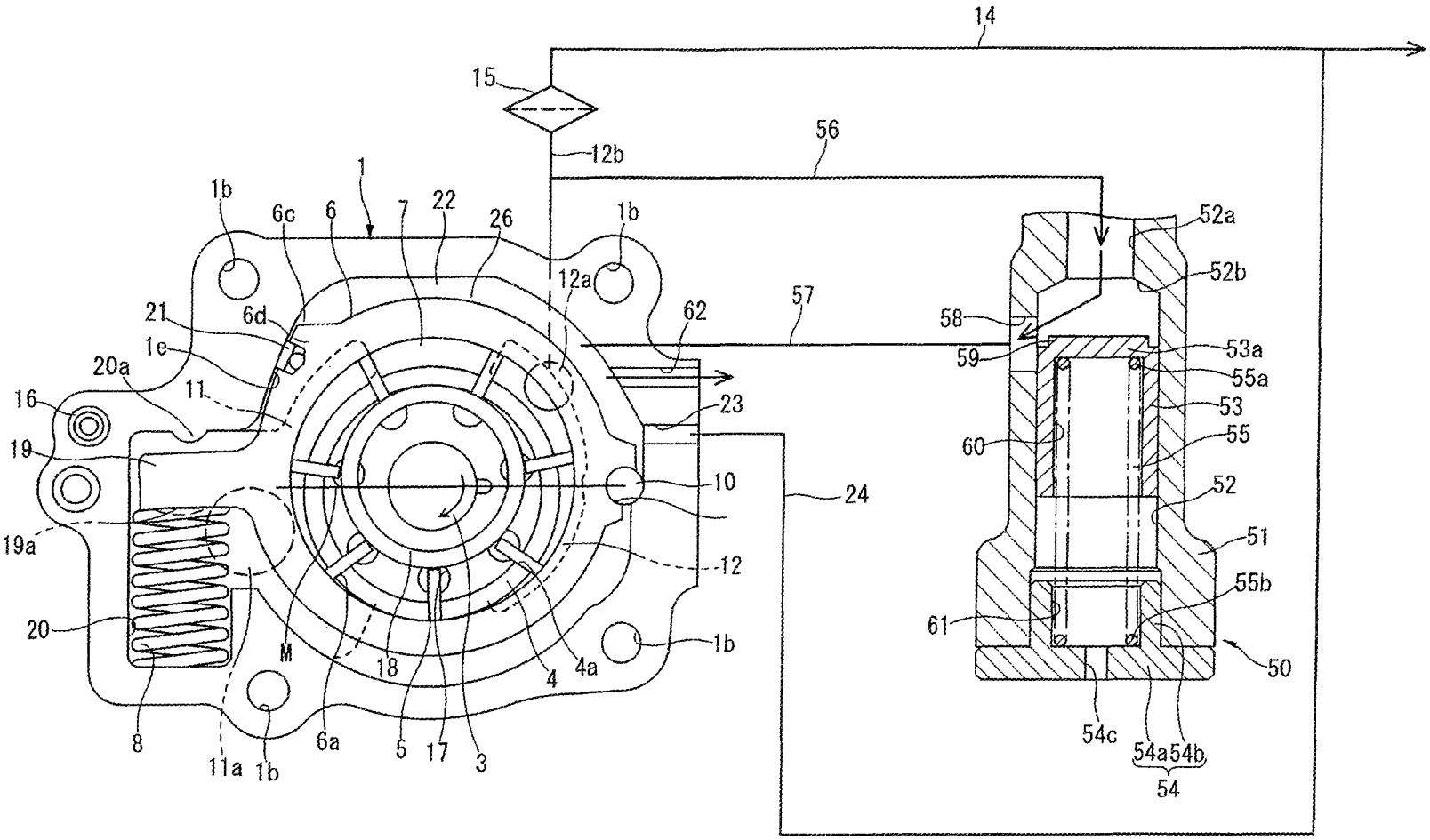
FIG. 13 is an operation explanation view when an oil flowing within the variable displacement oil pump has a high viscosity.

A fourth embodiment shown in FIG. 12 and FIG. 13 are a case where the present invention is applied to a mechanical variable displacement oil pump.

The variable displacement oil pump according to this embodiment has a configuration substantially identical to that of the first embodiment. However, the electromagnetic switching valve 30 and the connection passage 25 are omitted. Moreover, the control pressure introduction passage 24 is directly connected to the control hydraulic chamber 22 through the connection hole 23. Furthermore, the pump housing 1 includes the drain port 62 arranged to discharge the oil within the control hydraulic chamber 22, in accordance with the omission of the electromagnetic switching valve 30, like the second embodiment.

By this configuration, the variable displacement oil pump pressurizes supplies the oil in accordance with the rotation of the engine, and supplies the pressurized oil from the discharge port 12 to the main oil gallery 14. A part of the oil is constantly supplied through the control is pressure introduction passage 24 and the connection hole 23 to the control hydraulic chamber 22.

In this case, the control hydraulic chamber 22 is opened through the drain port 62 to the outside of the pump. Accordingly, the hydraulic pressure obtained by subtracting the discharged hydraulic pressure from the supplied hydraulic pressure is acted to the control hydraulic chamber 22.

Figure 14:
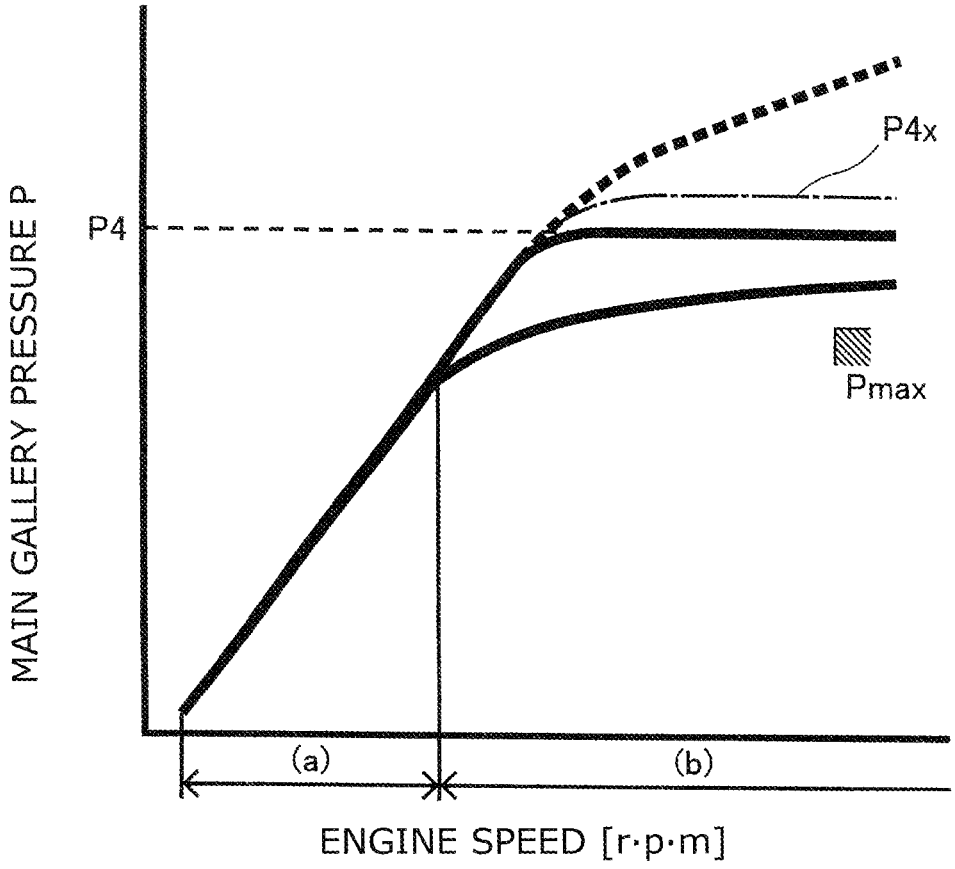
FIG. 14 is a characteristic diagram showing a relationship between a discharge pressure of the variable displacement oil pump according to the fourth embodiment, and an engine speed.

That is, in a low rotation region (a) of FIG. 14 in which the engine speed is relatively low, the oil amount supplied from the control pressure introduction passage 24 to the control hydraulic chamber 22 is relatively small. Most of the oil is discharged through the drain port 62 to the outside of the pump. Accordingly, the internal pressure of the control hydraulic chamber 22 is hardly increased.

With this, the hydraulic pressure is not acted to the pressure receiving surface 26. The cam ring 6 is maintained to be urged in the eccentric direction by the spring force of the coil spring 8. The discharge pressure is increased to be substantially proportional to the increase of the engine speed, so that the main gallery pressure is increased to be substantially proportional to the engine speed, as shown in FIG. 14(*a*).

When the engine speed reaches a middle high rotation speed region (b) in FIG. 14, the main gallery pressure is increased so that the oil amount flowing through the main oil gallery is increased. Accordingly, the oil amount supplied to the control hydraulic chamber 22 is increased. Consequently, the amount of the oil supplied to the control hydraulic chamber 22 becomes greater than the amount of the oil discharged through the drain port 62, so that the oil is remained within the control hydraulic chamber 22. Therefore, the internal pressure of the control hydraulic chamber 22 is increased.

With this, the pressure receiving surface 26 receives the hydraulic pressure within the control hydraulic pressure 22. Accordingly, the cam ring 6 is moved in the concentric direction against the spring force of the coil spring 8, so that the increase of the hydraulic pressure is suppressed.

In this case, the variable displacement oil pump is controlled so that the main gallery pressure becomes a predetermined high pressure slightly higher than the maximum required pressure $P_{max}$ in a predetermined high rotation speed region in which the lubrication of the bearing portion of the crank shaft is needed, as shown in FIG. 14. With this, it is possible to effectively lubricate the bearing portion without acting the excessive hydraulic pressure to the bearing portion of the crank shaft.

In the variable displacement oil pump according to this embodiment, in a case where the load is suddenly applied at the start of the engine to obtain the high rotation speed, the oil having the high viscosity by being cooled during the stop of the engine may be discharged from the discharge port 12.

In this case, normally, the oil discharged from the discharge port 12 is rapidly supplied to the control hydraulic chamber 22 to suppress the discharge pressure. However, when the oil has the high viscosity, the long time period is needed for the oil reaching the control hydraulic chamber 22, so that the suppression of the control of the discharge pressure is delayed.

Accordingly, the high pressure oil is excessively discharged from the discharge port 12 while the discharge pressure is suppressed. The discharge pressure and the main gallery pressure temporarily become the high pressure characteristic shown by a broken line of FIG. 14. These high pressure discharge pressure and the high pressure main gallery pressure are acted so that the breakage of the oil filter 15 and the malfunction such as the failure of the variable displacement oil pump may be caused.

Contrary to this, in this embodiment, there is provided the failsafe valve 50. With this, it is possible to suppress the generation of the above-described malfunction.

That is, in the failsafe valve 50, when the discharge pressure acted to the pressure receiving portion 59 is small, the tip end edge of the pressure receiving portion 59 is held to be seated on the seat surface 52*b* by the spring force of the control spring 55, as shown in FIG. 12. However, when the discharge pressure reaches the high pressure P4x slightly higher than the high pressure P4, the high pressure P4x is acted to the pressure receiving portion 59, so that the pressure sensitive valve member 53 is moved toward the sealing plug 54 against the spring force of the control spring 55, as shown in FIG. 13.

With this, the discharge pressure introduction opening 52*a* and the supply port 58 are connected with each other. Consequently, the oil discharged from the discharge port 12 is supplied to the control hydraulic chamber 22 through the discharge pressure introduction opening 52*a*, the receiving hole 52, the supply port 58, and the connection passage 57.

In this case, a part of the oil supplied to the control hydraulic chamber 22 is discharged from the drain port 62 to the outside. However, most of the oil supplied to the control hydraulic chamber 22 is remained within the control hydraulic chamber 22. Accordingly, the internal pressure of the control hydraulic chamber 22 is increased. Consequently, the cam ring 6 is moved in the concentric direction against the spring force of the coil spring 8, as shown in FIG. 13. Therefore, the discharge pressure is suppressed from becoming equal to or greater than the high pressure P4x.

On the other hand, when the discharge pressure becomes smaller than the high pressure P4x in accordance with the decrease of the eccentric amount of the cam ring 6, the force acted to the pressure receiving portion 59 is decreased. Accordingly, the pressure sensitive valve member 53 is pressed by the control spring 55 to be slightly moved from the state of FIG. 13 in the upward direction.

Consequently, the opening area of the supply port 58 is decreased, so that the oil supplied to the control hydraulic chamber 22 is decreased. Therefore, the hydraulic pressure within the control hydraulic chamber 22 is decreased, so that the eccentric amount of the cam ring 6 is increased. Accordingly, the discharge pressure is increased again.

As described above, the variable displacement oil pump is arranged to increase and decrease the opening area of the supply port 58 by the slight sliding movement of the sensitive pressure valve member 53 according to the variation of the discharge pressure, to increase and decrease the internal pressure of the control hydraulic pressure 22, thereby to regulate the discharge pressure to the high pressure P4x, and to regulate the main gallery pressure to the high pressure P4, as shown in FIG. 14.

Accordingly, in this embodiment, it is possible to suppress the excessive increases of the discharge pressure and the main gallery pressure even when the oil has the high viscosity. Therefore, it is possible to decrease the risk such as the breakage of the oil filter 15, and the failure of the variable displacement oil pump due to the excessive hydraulic pressure.

Moreover, the main gallery pressure is not decreased to be lower than the maximum required pressure $P_{max}$ at the predetermined high rotation although the excessive increases of the discharge pressure and the main gallery pressure are suppressed. Accordingly, it is possible to continuously perform the lubrication of the bearing portion of the crank shaft.

Fifth Embodiment

Figure 15:
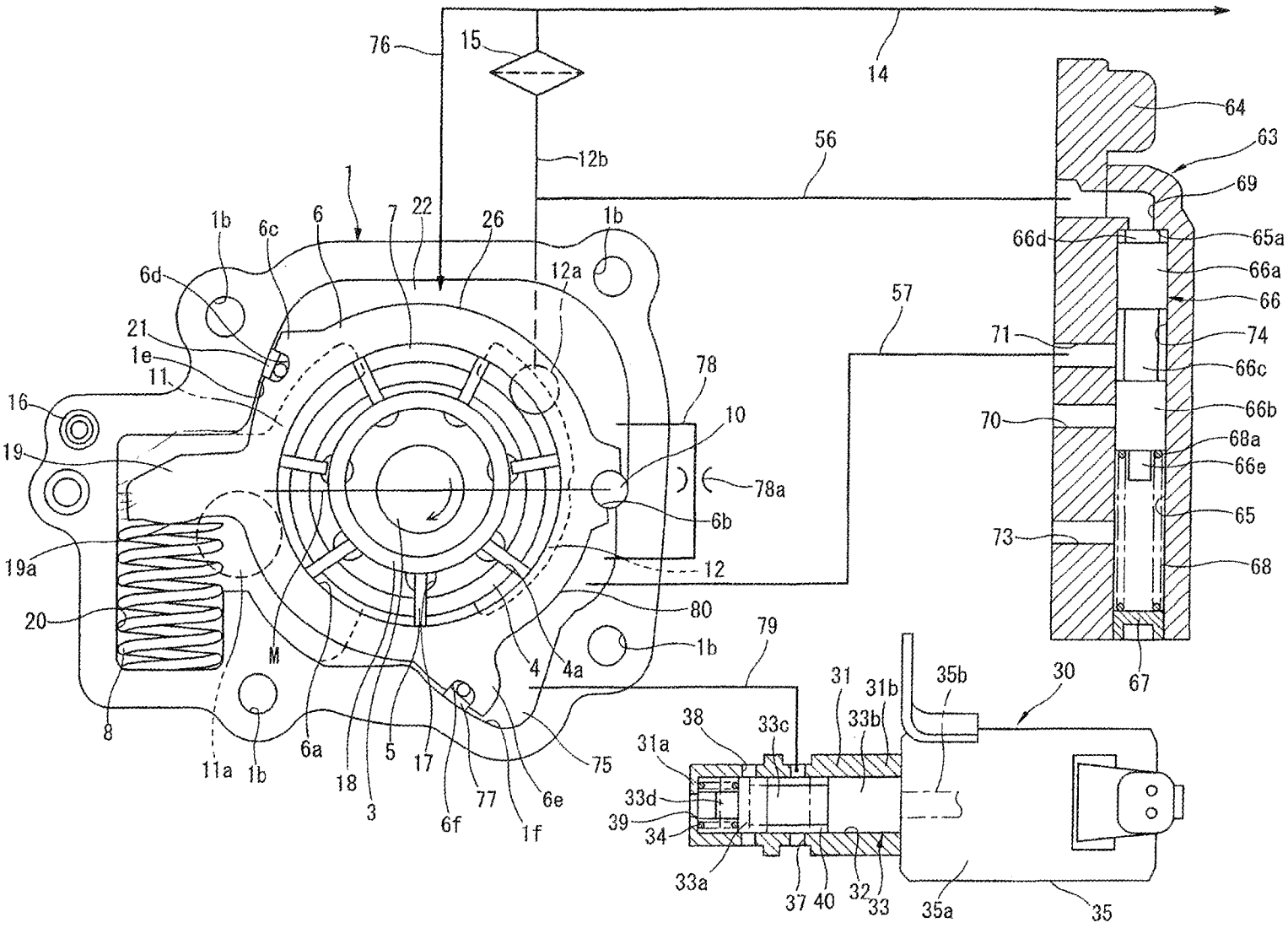
FIG. 15 is a schematic view showing a variable displacement oil pump according to a fifth embodiment.
Figure 16:
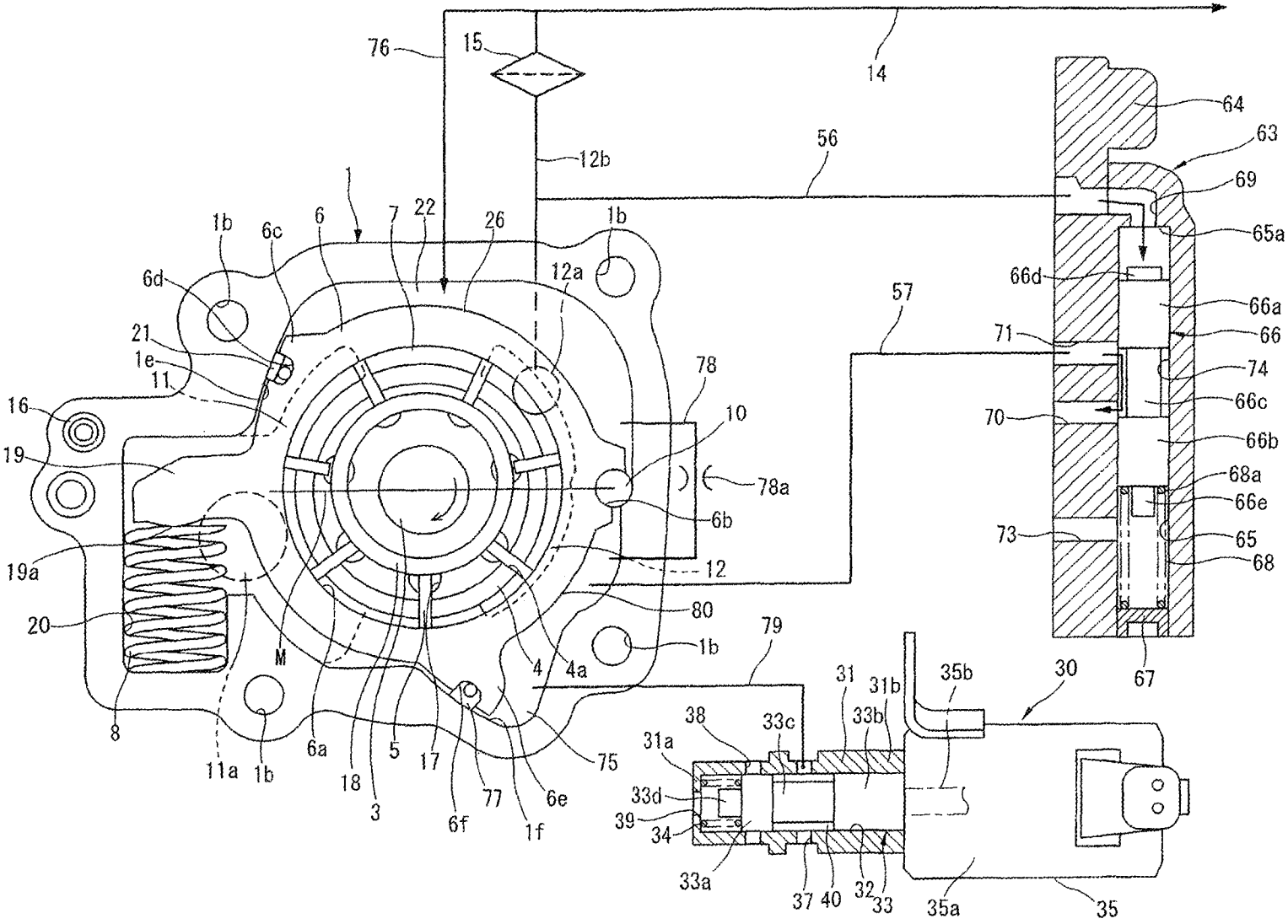
FIG. 16 is an operation explanation view of the variable displacement oil pump when an electromagnetic switching valve is failed.

FIG. 15 and FIG. 16 show a fifth embodiment according to the present invention. The second embodiment has a basic configuration identical to that of the first embodiment. Accordingly, common configurations have the same numerals. Concrete explanations are omitted.

In this embodiment, a second control hydraulic chamber 75 which is an increase side control hydraulic chamber is formed within the pump housing 1 on a lower side of the pivot pin 10. That is, the first control hydraulic chamber 22 and the second control hydraulic chamber 75 which are a control hydraulic chamber group are provided within the pump housing 1 on upper and lower positions to sandwich the cam ring reference line M (the pivot pin 10).

The main gallery pressure is supplied to the first control hydraulic chamber 22 through a first control pressure introduction passage 76 bifurcated from the main oil gallery 14.

In the configuration of the second control hydraulic chamber 75, a second seal sliding abutment surface 1*f* which has an arc shape is formed on an inner circumference surface of the pump housing 1 at a position substantially symmetrical to the seal sliding abutment surface 1*e* to sandwich the cam ring reference line M.

A second protruding portion 6*e* is formed on the cam ring 6 at a position corresponding to the second sliding abutment surface 1*f*. A second seal groove 6*f* is formed by cutting on an outer surface of the second protruding portion 6*e*. The second seal groove 6*f* has a substantially arc cross section. The second seal groove 6*f* extends along the axial direction of the cam ring 6. A second seal member 77 is received within the second seal groove 6*f*. The second seal member 77 is formed, for example, from a low abrasion synthetic resin into an elongated linear shape. The second seal member 77 is slidably abutted on the second sliding abutment surface 1*f* at the eccentric swing movement of the cam ring 6.

The second control hydraulic chamber 75 is defined by the inner circumference surface of the pump housing 1, the outer circumference surface of the cam ring 6, the pivot pin 10, the second seal member 77, the bottom surface of the pump receiving chamber 1*a*, and the inner side surface of the pump cover 2. The second control hydraulic chamber 75 is connected through a second control pressure introduction passage 78 having an orifice (throttling) 78*a* to the first control hydraulic chamber 22. With this, the hydraulic pressure slightly decreased relative to the internal pressure of the first control hydraulic chamber 22 is supplied from the first control hydraulic chamber 22 through the orifice 78*a* to the second control hydraulic chamber 75.

Furthermore, the second control hydraulic chamber 75 is connected through the drain passage 79 to the connection port 37 of the electromagnetic switching valve 30.

Moreover, in the second control hydraulic chamber 75, the outer circumference surface of the cam ring 6 which constitutes the second control hydraulic chamber 75 serves as a second pressure receiving surface 80. When the oil is supplied to the second control hydraulic chamber 75, the hydraulic pressure of the oil is acted to the second pressure receiving surface 80 so as to press the cam ring 6 in the eccentric direction, that is, in the direction in which the variation amounts of the volumes of the plurality of the pump chambers 7 are increased.

In this embodiment, the electromagnetic switching valve 30 has a basic configuration identical to that of the second embodiment. However, in left and right ports of FIG. 15 which are formed in the valve body 31, the port on the side of the air vent hole 39 is varied to have a function of the drain port 38. On the other hand, the port on the side of the solenoid section 35 is varied to have a function of the connection port 37.

By this configuration, when the electric controller does not energize the electromagnetic coil, the push rod 35*b* does not urge the spool valve member 33, so that the spool valve member 33 is maximally urged in the rightward direction of FIG. 15 by the valve spring 34. With this, the drain port 38 is closed by the outer circumference surface of the first land portion 33*a*. Accordingly, the oil within the second control hydraulic chamber 75 is not discharged from the drain port 38 through the drain passage 79, the connection port 37 and so on. The oil is held within the second control hydraulic chamber 75.

On the other hand, the electric controller applies the voltage to the electromagnetic coil, the spool valve member 33 is pushed by the push rod 35*b* as shown by one dot chain line of FIG. 15. The spool valve member 33 is moved in the leftward direction of the drawing against the spring force of the valve spring 34, so that the closed drain port 38 is partly opened.

In this case, the opening area of the drain port 38 is increased as the voltage applied from the electric controller to the electromagnetic coil is increased. That is, the amount of the oil discharged from the second control hydraulic chamber 75 through the connection port 37 to the outside of the pump is increased as the voltage applied to the electromagnetic coil.

In this embodiment, the failsafe valve 63 has a basic configuration identical to that of the third embodiment. However, the discharge pressure introduction port 72 is omitted. Moreover, a forming position of the drain port 70 is varied.

That is, the drain port 70 is formed at a predetermined position of the receiving hole 65 which is a side of the plug 67 of the connection port 71 in the axial direction. The drain port 70 is arranged to be connected to the annular passage 74 in accordance with the sliding position of the spool valve member 66.

Furthermore, in this embodiment, the connection port 71 is connected through the connection passage 57 to the second control hydraulic chamber 75.

Operations of Fifth Embodiment

Hereinafter, operations of the variable displacement oil pump according to the fifth embodiment is explained.

When the oil is discharged from the discharge port 12 in accordance with the rotation of the drive shaft 3, a part of the discharged oil is supplied from the main oil gallery 14 through the first control pressure introduction passage 76 to the first control hydraulic chamber 22, and supplied from the first control hydraulic chamber 22 through the second control pressure introduction passage 78 and the orifice 78*a* to the second control hydraulic chamber 75.

In this case, the energization from the electric controller to the electromagnetic coil of the electromagnetic switching valve 30 is shut off in the low rotation region after the start of the engine. Accordingly, as shown in FIG. 15, the spool valve member 33 is not pressed by the push rod 35*b*, so that the spool valve member 33 is maximally urged by the valve spring 34 in the rightward direction of the drawing. The drain port 38 is closed by the outer circumference surface of the first land portion 33*a* of the spool valve member 33.

Accordingly, the internal pressure of the first control hydraulic chamber 22 is increased by the supply of the oil. On the other hand, in the second control hydraulic chamber 75, the supplied oil is not discharged from the drain port 70, and the supplied oil is remained in the second control hydraulic chamber 75. Consequently, the internal pressure of the second control hydraulic chamber 75 is increased.

Accordingly, the cam ring 6 cannot be rotated against the spring force of the coil spring 8. The cam ring 6 is held to a state where the upper surface of the arm 19 is abutted on the restriction protruding portion 20*a*, that is, the maximum eccentric state where the eccentric amount becomes maximum.

Consequently, the discharge pressure of the variable displacement oil pump at the non-actuation of the electromagnetic switching valve 30 is increased to be proportional to the increase of the engine speed. Accordingly, the main gallery pressure is increased to be proportional to the increase of the engine speed, as shown in FIG. 6.

When the main gallery pressure is increased to be equal to or greater than a predetermined value, the electromagnetic switching valve 30 is actuated to control the main gallery pressure to the arbitrary pressure such as the low pressure P1, the middle pressure P2, and the high pressure P3 in accordance with the required pressure of the engine.

Hereinafter, the pressure regulation control of the main gallery pressure is different only in the voltage value of the voltage applied from the electric controller to the electromagnetic coil, and the applying timing. Accordingly, only the case where the main gallery pressure is regulated to the low pressure P1 is explained. The other cases are omitted.

In a case where the main oil gallery pressure is regulated to the low pressure P1, the electric controller starts the energization to the electromagnetic coil of the electromagnetic switching valve 30 when the main gallery pressure reaches the low pressure P1. With this, as shown by one dot chain line in FIG. 15, the spool valve member 33 is pressed by the push rod 35*b* to be moved in the leftward direction of the drawing against the spring force of the valve spring 34, so that the drain port 38 is connected to the connection port 37.

Consequently, a part of the oil within the second control hydraulic chamber 75 is discharged through the drain passage 79, the connection port 37, the annular passage 40, and the drain port 38 to the outside, so that the internal pressure of the second control hydraulic chamber 75 is decreased.

Accordingly, the hydraulic pressure of the oil acted to the pressure receiving surface 26 of the first control hydraulic chamber 22 becomes higher than the hydraulic pressure acted to the pressure receiving surface 80 of the second control hydraulic chamber 75. The cam ring 6 is rotated in the concentric direction against the spring force of the coil spring 8. Consequently, the main oil gallery pressure is suppressed from becoming equal to or greater than the low pressure P1.

On the other hand, when the main oil gallery pressure becomes smaller than the low pressure P1 in accordance with the decrease of the eccentric amount of the cam ring 6, the voltage applied from the electric controller to the electromagnetic coil is slightly decreased, so that the spool valve member 33 is slightly moved in the rightward direction.

Accordingly, the opening area of the drain port 38 is decreased. With this, the oil discharged from the second control hydraulic chamber 75 to the outside is decreased. Consequently, the hydraulic pressure within the control hydraulic chamber 75 is increased, so that the eccentric amount of the cam ring 6 is increased. Therefore, the pump discharge pressure and the main gallery pressure are increased again.

In this way, the variable displacement oil pump is arranged to increase and decrease the opening areas of the drain port 38 in accordance with the sliding movement of the spool valve member 33, to increase and decrease the internal pressure of the second control hydraulic chamber 75, and thereby to regulate the main gallery pressure to the low pressure P1, as shown in FIG. 6.

Moreover, in this embodiment, the failsafe valve 63 can attain the failsafe when the malfunction is caused in the electromagnetic switching valve 30 and so on, like the failsafe valve of the first embodiment.

When the electromagnetic switching valve 30 is failed due to the breaking and so on, the energization from the electric controller to the electromagnetic coil is shut off. Accordingly, the spool valve member 33 is not pressed by the push rod 35*b*, the spool valve member 33 is constantly maximally urged in the rightward direction of the drawing, as shown in FIG. 16.

With this, the connection port 37 and the drain port 38 are disconnected by the first land portion 33*a* of the spool valve member 33. Accordingly, the oil within the second control hydraulic chamber 75 is not discharged, so that the cam ring 6 is constantly positioned at the maximum eccentric position.

Accordingly, as shown by a broken line of FIG. 6, the variable displacement oil pump has a hydraulic pressure characteristic in which the main oil gallery pressure is gradually increased in accordance with the increase of the engine speed. When the main gallery pressure reaches a high pressure P4 higher than the maximum required pressure $P_{max}$, the failsafe valve 63 is actuated to adjust the main gallery pressure.

Specifically, in the failsafe valve 63, when the engine speed is low and the discharge pressure (the pilot pressure) acted to the pressure receiving portion 66*d* is small, the tip end edge of the pressure receiving portion 66*d* is held to be seated on the seat surface 65*a* by the spring force of the control spring 68, as shown in FIG. 15. However, when the discharge pressure reaches the high pressure P4x slightly higher than the high pressure P4 in accordance with the increase of the engine speed, the high pressure P4x is acted to the pressure receiving portion 66*d*, so that the spool valve member 66 is moved toward the plug 67 against the spring force of the control spring 68, as shown in FIG. 16.

With this, the connection port 71 and the drain port 70 are connected with each other. Consequently, the oil within the second control hydraulic chamber 75 is discharged through the connection passage 57, the connection port 71, the annular passage 74, and the drain port 70 to the outside of the pump.

Consequently, the cam ring 6 is moved in the concentric direction against the spring force of the coil spring 8, as shown in FIG. 16. Therefore, the discharge pressure is suppressed from becoming equal to or greater than the high pressure P4x.

On the other hand, when the discharge pressure becomes smaller than the high pressure P4x in accordance with the decrease of the eccentric amount of the cam ring 6, the force acted to the pressure receiving portion 66*d* is decreased. Accordingly, the spool member 66 is pressed by the control spring 68 to be slightly moved from the state of FIG. 16 in the upward direction of the drawing.

Consequently, the opening area of the drain port 70 with respect to the annular passage 74 is decreased. Accordingly, the oil supplied to the control hydraulic chamber 22 is decreased. Therefore, the hydraulic pressure discharged from the second control hydraulic chamber 75 to the outside is decreased, so that the eccentric amount of the cam ring 6 is increased. Accordingly, the discharge pressure is increased again.

As described above, the variable displacement oil pump is arranged to increase and decrease the opening areas of the drain port 70 by the slight sliding movement of the spool valve member 66 according to the variation of the discharge pressure, to increase and decrease the internal pressure of the second control hydraulic pressure 75, thereby to regulate the discharge pressure to the high pressure P4x, and to regulate the main gallery pressure to the high pressure P4, as shown in FIG. 6.

Moreover, in this embodiment, the first and second control hydraulic chambers 22 and 75 are formed on the outer circumference region to sandwich the cam ring reference line M (the pivot pin 10). Accordingly, it is possible to suppress the unintended swing movement of the cam ring when the hydraulic pressure within the cam ring 6 (the pump chambers 7) is decreased due to the generation of the bubbles (aeration) in the oil.

Sixth Embodiment

Figure 17:
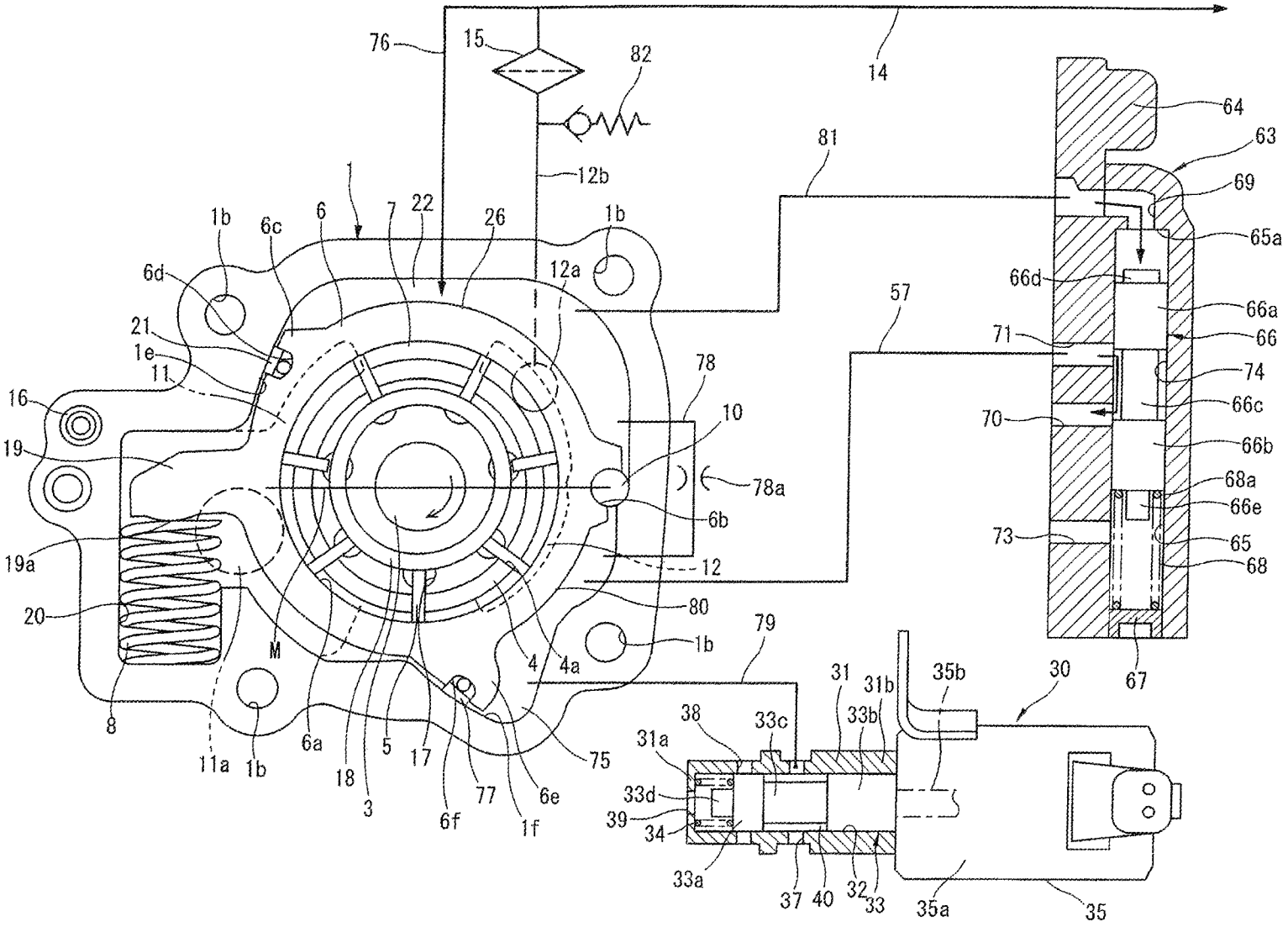
FIG. 17 is an operation explanation view of the variable displacement oil pump according to a sixth embodiment when an electromagnetic switching valve is failed.

A sixth embodiment shown in FIG. 17 has a basic configuration identical to the fifth embodiment. However, the pilot pressure introduction opening 69 of the failsafe valve 63 is connected through the pilot pressure introduction passage 81 to the first control hydraulic chamber 22. With this, the hydraulic pressure within the first control hydraulic chamber 22 is acted as the pilot pressure to the tip end surface of the pressure receiving portion 66*d* of the spool valve member 66.

Moreover, in the failsafe valve 63, when the hydraulic pressure acted to the pressure receiving portion 66*d* is lower than the high pressure P4 by varying the area of the tip end surface of the pressure receiving portion 66*d*, the set load of the control spring 68, and so on, the drain port 70 is closed by the outer circumference surface of the second land portion 66*b*. On the other hand, when the hydraulic pressure becomes equal to or greater than the high pressure P4, the drain port 70 and the connection port 71 are connected through the annular passage 74.

In this case, the hydraulic pressure is supplied from the main oil gallery 14 through the first control pressure introduction passage 76 to the first hydraulic chamber 22. Accordingly, the hydraulic pressure of the first hydraulic chamber 22 is substantially identical to the main gallery pressure. This main gallery pressure is slightly decreased from the discharge pressure due to the passage pressure loss and passing through the oil filter 15. However, the main oil gallery pressure is basically varied based on the variation of the discharge pressure.

Accordingly, in this embodiment, even when the failsafe valve 63 is controlled based on the internal pressure (the main gallery pressure) of the first control hydraulic chamber 22, it is possible to regulate the main oil gallery pressure similarly to the case where the failsafe valve 63 is controlled based on the discharge pressure like the fifth embodiment.

Consequently, in this embodiment, the introduction path of the pilot pressure with respect to the pilot pressure introduction opening 69 is varied, it is possible to attain the operations and effects which are identical to those of the fifth embodiment.

Besides, in this embodiment, a check ball valve 82 is provided in the discharge passage 12*b* arranged to open the valve to discharge the oil to the outside to decrease the discharge pressure when the discharge pressure is excessively increased. This check ball valve 82 is an auxiliary member acted only when the pressure regulation control by the failsafe valve 63 is insufficient.

Seventh Embodiment

Figure 18:
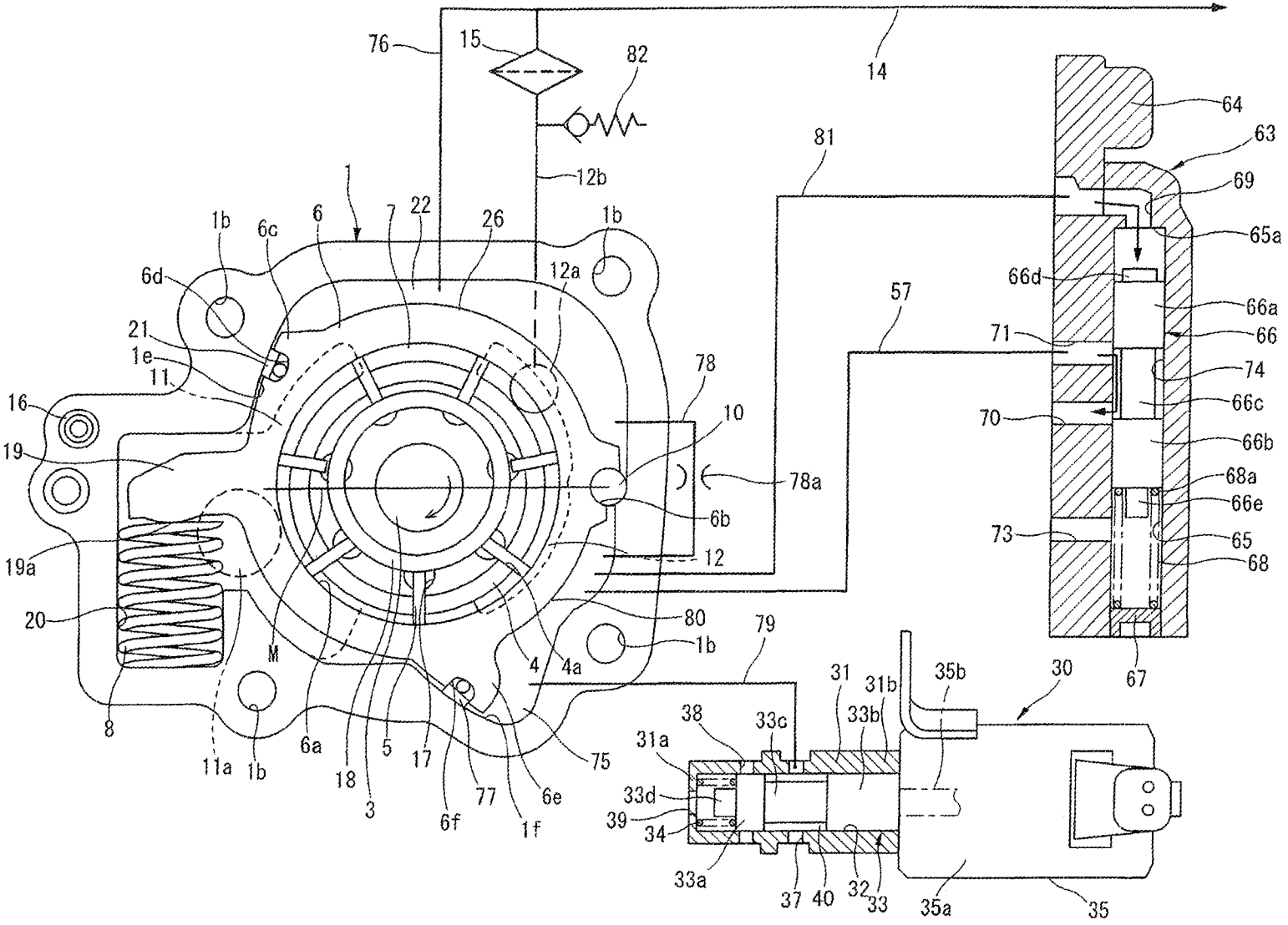
FIG. 18 is an operation explanation view of the variable displacement oil pump according to a seventh embodiment when an electromagnetic switching valve is failed.

A seventh embodiment shown in FIG. 18 has a basic configuration identical to that of the sixth embodiment. However, the pilot pressure introduction opening 69 of the failsafe valve 63 is connected through the pilot pressure introduction passage 81 to the second control hydraulic chamber 75. With this, the hydraulic pressure of the second control hydraulic chamber 75 is acted to the tip end surface of the pressure receiving portion 66*d* of the spool valve member 66.

In this case, the hydraulic pressure within the second control hydraulic chamber 75 is decreased due to passing through the orifice 78*a* of the second control pressure introduction passage 78. However, the hydraulic pressure within the second control hydraulic chamber 75 is basically varied based on the variation of the hydraulic pressure within the first control hydraulic chamber 22.

Accordingly, the set load of the control spring 68 of the failsafe valve 63 and so on is previously adjusted in consideration of the decrease amount when the oil passes through the orifice 78*a*. With this, even when the internal pressure of the second control hydraulic chamber 75 is supplied to the failsafe valve 63, it is possible to adjust the main oil gallery pressure like the sixth embodiment.

Consequently, in this embodiment, it is possible to attain the operation and effects which are identical to those of the sixth embodiment even when the supply source of the pilot pressure is varied to the second control hydraulic chamber 75.

Eighth Embodiment

Figure 19:
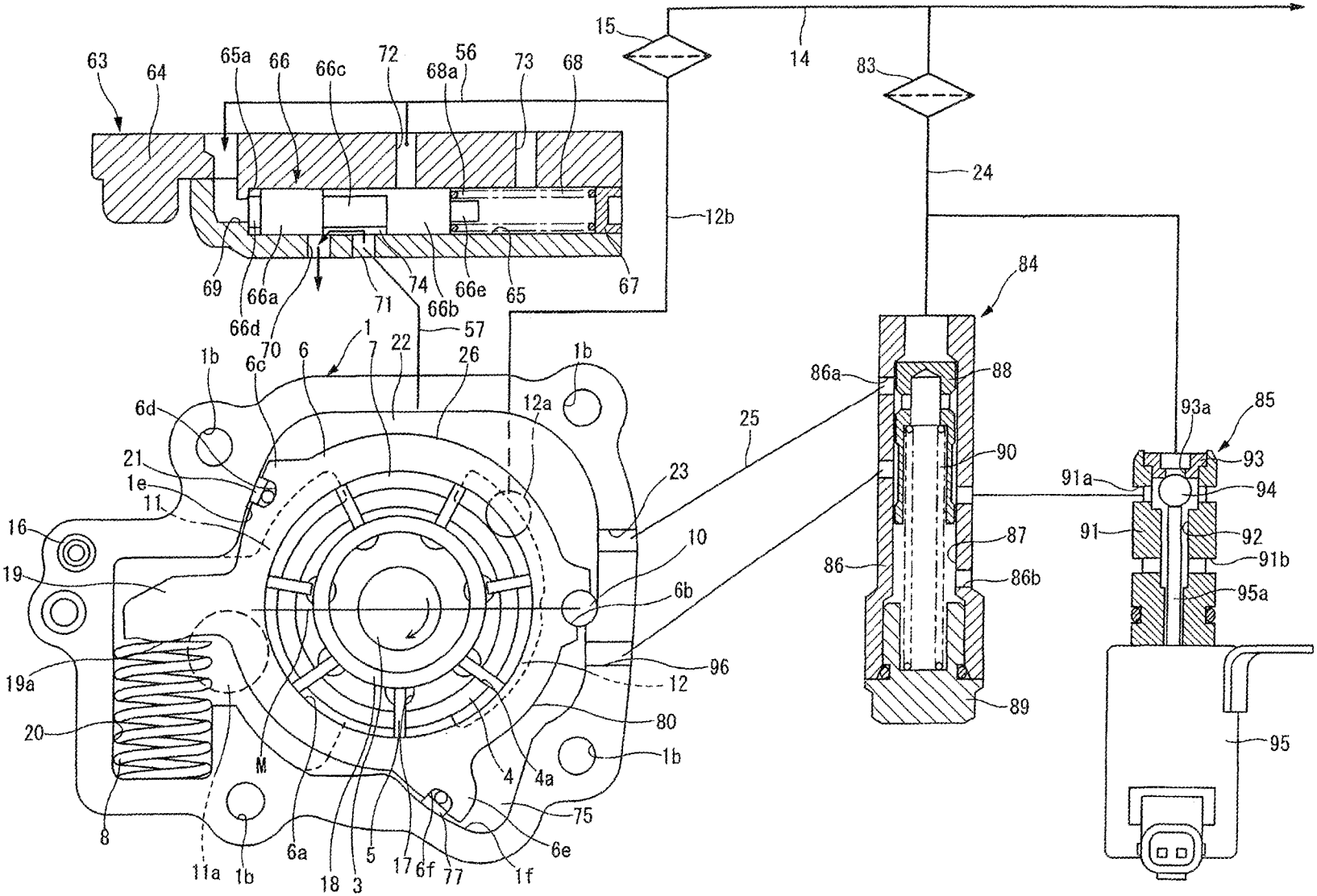
FIG. 19 is a schematic view showing a variable displacement oil pump according to an eighth embodiment.

A eighth embodiment shown in FIG. 19 is applied to two stepped variable displacement oil pump which is disclosed, for example, in a Japanese Patent Application No. 2014-105623, and which has a two stepped hydraulic pressure of the low pressure and the high pressure.

That is, in this variable displacement oil pump according to this embodiment, the first and second control hydraulic chambers 22 and 75 are formed on the both sides of the cam ring 6 to sandwich the cam ring reference line M.

A second oil filter 83 is provided in a middle of the flow path of the control pressure introduction passage 24 bifurcated from the main oil gallery 14. The control pressure introduction passage 24 is bifurcated to two passages at a position downstream of the second oil filter 83. A pressure sensitive valve 84 and a solenoid valve 85 are provided, respectively, at downstream ends of the bifurcated control pressure introduction passage 24.

The pressure sensitive valve includes a receiving hole 87 formed in a valve housing 86; a spool valve member 88 slidably received within the sliding hole 87; a plug 89 closing an opening portion of the receiving hole 87; and a spring member 90 elastically mounted between the plug 89 and the spool valve member 88, and arranged to constantly urge the spool valve member 88 in an upward direction of the drawing. When the hydraulic pressure of the oil introduced from the control pressure introduction passage 24 is equal to or smaller than a predetermined pressure, the oil within the first control hydraulic chamber 22 is discharged to the outside through the connection hole 23, the connection passage 25, a connection port 86*a* which is formed in the valve housing 86 at an upper position of the drawing to penetrate through the valve housing 86, the receiving hole 87, and a drain port 86*b* formed in the valve housing 86 at a lower position of the drawing. On the other hand, when the hydraulic pressure of the oil introduced from the control pressure introduction passage 24 is equal to or greater than the predetermined pressure, this oil is supplied through the connection port 86*a*, the connection passage 25, and the connection hole 23 to the first control hydraulic chamber 22.

The solenoid valve 85 includes a valve body 91 which includes an actuation hole 92 extending within the valve body 91 in the axial direction; a valve seat 93 which is mounted and fixed on an upper end portion (one end portion) of the actuation hole 92 of the drawing, and which includes an opening port 93*a* formed at a central position of the valve seat 93; a ball valve member 94 which is made from a metal, and which is arranged to open and close the opening port 93*a*; and a solenoid unit 95 which is connected to a base end portion (the other end portion) of the valve body 91, and which is arranged to urge the ball valve member 94 toward the valve seat 93 based on an ON signal outputted from the electric controller.

The valve body 91 includes a supply and discharge port 91*b* formed at a predetermined axial position, and connected to the second control hydraulic chamber 75 through a second connection hole 96 formed in a circumferential wall of the second control hydraulic chamber 75, the pressure sensitive valve 84, and so on; a drain port 91*b* connected to the atmospheric pressure outside the pump. Each of the supply and discharge port 91*b* and the drain port is formed to penetrate in the radial direction.

When the electric controller outputs an OFF signal to the solenoid unit 95, the supply and discharge port 91*a* is connected through the opening port 93*a* to the control pressure introduction passage 24. On the other hand, when the electric controller outputs the ON signal to the solenoid unit 95, the opening port 93*a* is closed by the ball valve member 94 urged by the push rod 95*a*, so that the supply and discharge port 91*a* and the control pressure introduction passage 24 are disconnected. Moreover, the supply and discharge port 91*a* is connected through the actuation hole 92 to the drain port 91*b*.

In this embodiment, the electric controller senses a current engine driving state from an oil temperature and a water temperature of the engine, the engine speed, the load and so on. In particular, when the engine speed is equal to or smaller than a predetermined speed, the electric controller outputs the ON signal to the solenoid valve 85 (the energization). When the engine speed is greater than the predetermined speed, the electric controller outputs the OFF signal (the energization). However, the electric controller outputs the OFF signal to the electromagnetic coil in the high load region of the engine and so on even when the engine speed is equal to or smaller than the predetermined speed.

By this configuration, the solenoid valve 85 is basically arranged to connect the supply and discharge port 91*a* and the drain port 91*b* when the engine speed is equal to or smaller than the predetermined speed, and thereby to discharge the oil within the second control hydraulic chamber 75 to the outside of the pump. On the other hand, the solenoid valve 85 is arranged to supply the oil within the control pressure introduction passage 24 to the second control hydraulic chamber 75 when the engine speed is higher than the predetermined speed.

Moreover, in this embodiment, there is provided the failsafe valve 63. The failsafe valve 63 has a configuration and a connection relationship which are identical to those of the third embodiment. Accordingly, detailed explanations are omitted.

Accordingly, in this embodiment, the solenoid valve 85 is arranged to be controller in the ON-OFF manner in accordance with the engine speed, and thereby to switch a state in which the oil is supplied only to the first control hydraulic chamber 22, and a state in which the oil is supplied to the both first and second control hydraulic chambers 22 and 75.

Figure 20:
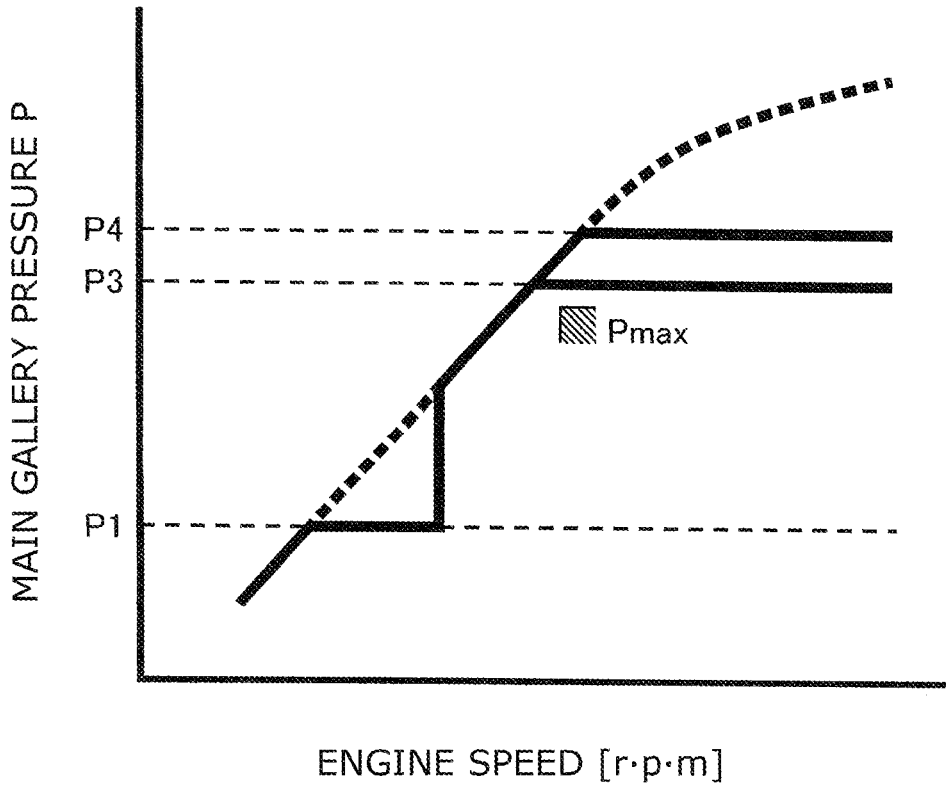
FIG. 20 is a characteristic diagram showing a relationship between a discharge pressure of the variable displacement oil pump according to the eighth embodiment, and an engine speed.

With this, the main gallery pressure can have, for example, two stepped hydraulic pressure characteristics having the low pressure P1 and the high pressure P3 as shown in FIG. 20.

Furthermore, in this embodiment, there is provided the failsafe valve 63. Accordingly, even in a case where the cooled oil having the high viscosity is excessively discharged from the discharge port 12 when the load is suddenly applied at the start of the engine to obtain the high rotation speed, the main gallery pressure is maintained to the high pressure P4 without becoming the high pressure characteristics shown by a broken line of FIG. 20. With this, it is possible to suppress from causing the malfunction such as the breakage of the oil filter 15, and the failure of the variable displacement oil pump.

For example, following aspects are considerable as the variable displacement oil pump based on the above-described embodiments.

According to one aspect, a variable displacement oil pump includes: a pump constituting section arranged to be rotationally driven by an engine, to vary volumes of a plurality of pump chambers, and to discharge an oil sucked from a suction portion; a movable member arranged to be moved to vary variation amounts of the volumes of the plurality of the pump chambers; an urging mechanism provided to have a set load, and arranged to urge the movable member in a direction in which the variation amounts of the volumes of the plurality of the pump chambers are increased; a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the movable member in a direction in which the variation amounts of the volumes of the plurality of the pump chambers are decreased; a drain mechanism arranged to discharge the oil from a specific one control hydraulic chamber of the control hydraulic chamber group; and a control valve which into which the oil of an upstream side that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber.

In one preferable aspect of the variable displacement pump, the variable displacement oil pump includes an electrically controlled mechanism arranged to supply or discharge the oil discharged from the discharge portion with respect to the specific one control hydraulic chamber, based on an electric signal.

In one preferable aspect of the variable displacement pump, in one of the aspects of the variable displacement oil pump, the electrically controlled mechanism is arranged to regulate the supply or the discharge of the oil discharged from the discharge portion to regulate the pressure within the specific one control hydraulic chamber, and thereby to regulate the hydraulic pressure of a downstream side which is discharged from the discharge portion to a plurality of set pressures.

In another preferable aspect of the variable displacement pump, in one of the aspects of the variable displacement oil pump, the specific one control hydraulic chamber is a decrease side control hydraulic chamber.

In another preferable aspect of the variable displacement pump, in one of the aspects of the variable displacement oil pump, the drain mechanism is provided to the electrically controlled mechanism.

In another preferable aspect of the variable displacement pump, in one of the aspects of the variable displacement oil pump, the drain mechanism is provided to a pump housing receiving the pump constituting section.

In another preferable aspect of the variable displacement pump, in one of the aspects of the variable displacement oil pump, the drain mechanism is provided to the control valve.

In another preferable aspect of the variable displacement pump, in one of the aspects of the variable displacement oil pump, the specific one control chamber is arranged to receive the oil discharged from the discharge portion, and thereby to act a force to the movable member in a direction where the variation amounts of the volumes of the plurality of the pump chambers are increased.

In another preferable aspect of the variable displacement pump, in one of the aspects of the variable displacement oil pump, the oil of the downstream side which is discharged from the discharge portion is supplied to the decrease side control hydraulic chamber; the oil of the downstream side which is discharged from the discharge portion is supplied through the decrease side control hydraulic chamber to the increase side control hydraulic chamber; and the electrically controlled mechanism is arranged to regulate the discharge of the oil to the increase side control hydraulic chamber.

In another preferable aspect of the variable displacement pump, in one of the aspects of the variable displacement oil pump, the oil introduced as the control hydraulic pressure to the control valve is the oil of the upstream side which is discharged from the discharge portion.

In another preferable aspect of the variable displacement pump, in one of the aspects of the variable displacement oil pump, the oil introduced as the control hydraulic pressure to the control valve is the oil of the decrease side control hydraulic chamber.

In another preferable aspect of the variable displacement pump, in one of the aspects of the variable displacement oil pump, the oil introduced as the control hydraulic pressure to the control valve is the oil of the increase side control hydraulic chamber.

In another preferable aspect of the variable displacement pump, in one of the aspects of the variable displacement oil pump, the specific one control hydraulic chamber is the increase side control hydraulic chamber arranged to receive the oil discharged from the discharge portion, and thereby to act a force to the movable member in a direction in which the variation amounts of the volumes of the plurality of the pump chambers are increased; and the electrically controlled mechanism is arranged to switch the supply or the discharge of the oil discharged from the discharge portion with respect to the increase side control hydraulic chamber.

In another preferable aspect of the variable displacement pump, in one of the aspects of the variable displacement oil pump, the specific one control hydraulic chamber is the decrease side control hydraulic chamber; and the oil of the downstream side which is discharged from the discharge portion is supplied to the decrease side control hydraulic chamber.

In another preferable aspect of the variable displacement pump, in one of the aspects of the variable displacement oil pump, a set actuation pressure of the control valve is set in a high pressure region greater than a maximum required pressure of the engine.

From another point of view, a variable displacement oil pump includes: a plurality of vanes received within an outer circumference portion of the rotor to be projectable and retractable from and into the outer circumference portion; a cam ring which receives the rotor and the vanes radially inside the cam ring to separate a plurality of pump chambers, and which is arranged to be eccentrically moved with respect to the rotor, and thereby to increase and decrease variation amounts of volumes of the plurality of the pump chambers; a suction portion formed and opened in a suction region in which internal volumes of the pump chambers are increased; a discharge portion formed and opened in a discharge region in which the internal volumes of the pump chambers are decreased; an urging member provided in a state in which a precompression is applied to the urging member, and arranged to urge the cam ring in a direction in which an eccentric amount is increased; a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the cam ring in a direction in which the variation amounts of the volumes of the plurality of the pump chambers are decreased; a drain mechanism arranged to discharge the oil from a specific one control hydraulic chamber of the control hydraulic chamber group; and a control valve which into which the oil of an upstream side that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber.

From another point of view, a variable displacement oil pump includes: a pump constituting section arranged to be rotationally driven by an engine, to vary volumes of a plurality of pump chambers, and to discharge an oil sucked from a suction portion; a movable member arranged to be moved to vary variation amounts of the volumes of the plurality of the pump chambers; an urging mechanism provided to have a set load, and arranged to urge the movable member in a direction in which the variation amounts of the volumes of the plurality of the pump chambers are increased; a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the movable member in a direction in which the variation amounts of the volumes of the plurality of the pump chambers are decreased; a drain mechanism arranged to discharge the oil from a specific one control hydraulic chamber of the control hydraulic chamber group; an electrically controlled mechanism arranged to regulate a supply or a discharge of the oil discharged from the discharge portion with respect to the specific one control hydraulic chamber, based on an electric signal, to regulate the pressure within the specific one control hydraulic chamber, and thereby to adjust the hydraulic pressure of the oil discharged from the discharge portion, to a plurality of set pressures; and a control valve which into which the oil of an upstream side that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber.

The invention claimed is:

1. A variable displacement oil pump comprising:

a pump constituting section arranged to be rotationally driven by an engine, to vary volumes of a plurality of pump chambers, and to discharge an oil sucked from a suction portion, from a discharge portion through an oil filter to an inside of the engine;

a movable member arranged to be moved to vary variation amounts of the volumes of the plurality of the pump chambers;

an urging mechanism provided to have a set load, and arranged to urge the movable member in a direction in which the variation amounts of the volumes of the plurality of the pump chambers are increased;

a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the movable member in a direction in which the variation amounts of the volumes of the plurality of the pump chambers are decreased;

a drain mechanism arranged to discharge the oil from a specific one control hydraulic chamber of the control hydraulic chamber group; and a control valve into which the oil of an upstream side of the filter that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber.

2. The variable displacement oil pump as claimed in claim 1, wherein the variable displacement oil pump includes an electrically controlled mechanism arranged to supply or discharge the oil discharged from the discharge portion with respect to the specific one control hydraulic chamber, based on an electric signal.

3. The variable displacement oil pump as claimed in claim 2, wherein the specific one control hydraulic chamber is an increase side control hydraulic chamber arranged to receive the oil discharged from the discharge portion, and thereby to act a force to the movable member in a direction in which the variation amounts of the volumes of the plurality of the pump chambers are increased; and the electrically controlled mechanism is arranged to switch the supply or the discharge of the oil discharged from the discharge portion with respect to the increase side control hydraulic chamber.

4. A variable displacement oil pump comprising:

a pump constituting section arranged to be rotationally driven by an engine, to vary volumes of a plurality of pump chambers, and to discharge an oil sucked from a suction portion, from a discharge portion through an oil filter to an inside of the engine;

a movable member arranged to be moved to vary variation amounts of the volumes of the plurality of the pump chambers;

an urging mechanism provided to have a set load, and arranged to urge the movable member in a direction in which the variation amounts of the volumes of the plurality of the pump chambers are increased;

a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the movable member in a direction in which the variation amounts of the volumes of the plurality of the pump chambers are decreased;

a drain mechanism arranged to discharge the oil from a specific one control hydraulic chamber of the control hydraulic chamber group; and a control valve into which the oil of an upstream side of the filter that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber, wherein the variable displacement oil pump includes an electrically controlled mechanism arranged to supply or discharge the oil discharged from the discharge portion with respect to the specific one control hydraulic chamber, based on an electric signal, and wherein the electrically controlled mechanism is arranged to regulate the supply or the discharge of the oil discharged from the discharge portion to regulate the pressure within the specific one control hydraulic chamber, and thereby to regulate the hydraulic pressure of a downstream side of the filter which is discharged from the discharge portion to a plurality of set pressures.

5. The variable displacement oil pump as claimed in claim 4, wherein the specific one control hydraulic chamber is a decrease side control hydraulic chamber.

6. The variable displacement oil pump as claimed in claim 5, wherein the drain mechanism is provided to the electrically controlled mechanism.

7. The variable displacement oil pump as claimed in claim 5, wherein the drain mechanism is provided to a pump housing receiving the pump constituting section.

8. The variable displacement oil pump as claimed in claim 5, wherein the drain mechanism is provided to the control valve.

9. The variable displacement oil pump as claimed in claim 4, wherein the specific one control chamber is an increase side control hydraulic chamber arranged to receive the oil discharged from the discharge portion, and thereby to act a force to the movable member in a direction where the variation amounts of the volumes of the plurality of the pump chambers are increased.

10. The variable displacement oil pump as claimed in claim 9, wherein the oil of the downstream side which is discharged from the discharge portion is supplied to the decrease side control hydraulic chamber; the oil of the downstream side which is discharged from the discharge portion is supplied through the decrease side control hydraulic chamber to the increase side control hydraulic chamber; and the electrically controlled mechanism is arranged to regulate the discharge of the oil to the increase side control hydraulic chamber.

11. The variable displacement oil pump as claimed in claim 10, wherein the oil introduced as the control hydraulic pressure to the control valve is the oil of the upstream side which is discharged from the discharge portion.

12. The variable displacement oil pump as claimed in claim 10, wherein the oil introduced as the control hydraulic pressure to the control valve is the oil of the decrease side control hydraulic chamber.

13. The variable displacement oil pump as claimed in claim 10, wherein the oil introduced as the control hydraulic pressure to the control valve is the oil of the increase side control hydraulic chamber.

14. A variable displacement oil pump comprising:

a pump constituting section arranged to be rotationally driven by an engine, to vary volumes of a plurality of pump chambers, and to discharge an oil sucked from a suction portion, from a discharge portion through an oil filter to an inside of the engine;

a movable member arranged to be moved to vary variation amounts of the volumes of the plurality of the pump chambers;

an urging mechanism provided to have a set load, and arranged to urge the movable member in a direction in which the variation amounts of the volumes of the plurality of the pump chambers are increased;

a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the movable member in a direction in which the variation amounts of the volumes of the plurality of the pump chambers are decreased;

a drain mechanism arranged to discharge the oil from a specific one control hydraulic chamber of the control hydraulic chamber group; and a control valve into which the oil of an upstream side of the filter that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber, wherein the specific one control hydraulic chamber is the decrease side control hydraulic chamber; and the oil of a downstream side of the filter which is discharged from the discharge portion is supplied to the decrease side control hydraulic chamber.

15. The variable displacement oil pump as claimed in claim 14, wherein a set actuation pressure of the control valve is set in a high pressure region greater than a maximum required pressure of the engine.

16. A variable displacement oil pump comprising:

a plurality of vanes received within an outer circumference portion of a rotor to be projectable and retractable from and into the outer circumference portion;

a cam ring which receives the rotor and the vanes radially inside the cam ring to separate a plurality of pump chambers, and which is arranged to be eccentrically moved with respect to the rotor, and thereby to increase and decrease variation amounts of volumes of the plurality of the pump chambers;

a suction portion formed and opened in a suction region in which internal volumes of the pump chambers are increased;

a discharge portion formed and opened in a discharge region in which the internal volumes of the pump chambers are decreased;

an urging member provided in a state in which a precompression is applied to the urging member, and arranged to urge the cam ring in a direction in which an eccentric amount is increased;

a control hydraulic chamber group including one or more control hydraulic chamber which is arranged to vary the variation amounts of the volumes of the plurality of the pump chambers, and which includes at least a decrease side control hydraulic chamber arranged to receive the oil discharged from the discharge portion, and thereby to act a force to the cam ring in a direction in which the variation amounts of the volumes of the plurality of the pump chambers are decreased;

a drain mechanism arranged to discharge the oil from a specific one control hydraulic chamber of the control hydraulic chamber group; and a control valve into which the oil of an upstream side of a filter that is discharged from the discharge portion, or the oil from the control hydraulic chamber is introduced as a control hydraulic pressure, which is arranged to supply the oil of the upstream side that is discharged from the discharge portion to the specific one control hydraulic chamber, or to discharge the oil from the specific one control hydraulic chamber by the drain mechanism to regulate the pressure of the specific one control hydraulic chamber, wherein the variable displacement oil pump includes an electrically controlled mechanism arranged to supply or discharge the oil discharged from the discharge portion with respect to the specific one control hydraulic chamber, based on an electric signal, and wherein the electrically controlled mechanism is arranged to regulate the supply or the discharge of the oil discharged from the discharge portion to regulate the pressure within the specific one control hydraulic chamber, and thereby to regulate the hydraulic pressure of a downstream side of the filter which is discharged from the discharge portion to a plurality of set pressures.

* * * * *